US011946325B2

(12) United States Patent
Magnuson

(10) Patent No.: US 11,946,325 B2
(45) Date of Patent: Apr. 2, 2024

(54) SPINNER WEAR DETECTION

(71) Applicant: NABORS DRILLING TECHNOLOGIES USA, INC., Houston, TX (US)

(72) Inventor: Christopher Magnuson, Houston, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 264 days.

(21) Appl. No.: 17/127,657

(22) Filed: Dec. 18, 2020

(65) Prior Publication Data

US 2021/0189810 A1 Jun. 24, 2021

Related U.S. Application Data

(60) Provisional application No. 62/951,948, filed on Dec. 20, 2019.

(51) Int. Cl.
*E21B 19/16* (2006.01)
*E21B 17/042* (2006.01)

(52) U.S. Cl.
CPC ..... *E21B 19/165* (2013.01); *E21B 17/042* (2013.01); *E21B 19/161* (2013.01)

(58) Field of Classification Search
CPC ..... E21B 19/161; E21B 19/165; E21B 17/042
See application file for complete search history.

(56) References Cited

U.S. PATENT DOCUMENTS

| | | | |
|---|---|---|---|
| 3,122,211 | A | 2/1964 | Wilson et al. |
| 5,205,671 | A | 4/1993 | Handford |
| 6,253,845 | B1 | 7/2001 | Belik |
| 7,000,502 | B2 | 2/2006 | Belik |
| 7,665,533 | B2 | 2/2010 | Hopwood et al. |
| 7,707,914 | B2 | 5/2010 | Pietras et al. |
| 7,841,415 | B2 | 11/2010 | Winter |
| 8,042,432 | B2 | 10/2011 | Hunter et al. |
| 8,667,869 | B2 | 3/2014 | Ge |
| 8,726,743 | B2 | 5/2014 | Ruehmann et al. |
| 9,453,378 | B2 | 9/2016 | Ge |
| 9,464,492 | B2 | 10/2016 | Austefjord et al. |
| 9,567,816 | B2 | 2/2017 | Bertelsen |
| 10,309,170 | B2 | 6/2019 | Bourgeois et al. |
| 10,422,450 | B2 | 10/2019 | Ruehmann et al. |

(Continued)

FOREIGN PATENT DOCUMENTS

| | | | |
|---|---|---|---|
| BR | 200414141 | A | 10/2006 |
| CA | 2537698 | A1 | 3/2005 |

(Continued)

*Primary Examiner* — Christopher J Sebesta
(74) *Attorney, Agent, or Firm* — Abel Schillinger, LLP

(57) ABSTRACT

A system including a spinner assembly that includes a spinner subassembly which includes a spinner configured to engage a tubular, and a drive gear coupled to the spinner, with the drive gear configured to drive rotation of the spinner, and the encoder configured to count teeth of the drive gear as the drive gear rotates. A controller configured to determine a number of revolutions of a tubular that are needed to thread the tubular to a tubular string based on data from the encoder. The controller is also configured to determine when the tubular is unthreaded from the tubular string based on data from the encoder.

15 Claims, 21 Drawing Sheets

(56) References Cited

U.S. PATENT DOCUMENTS

| | | | | |
|---|---|---|---|---|
| 10,648,253 | B2 | 5/2020 | Kaasin | |
| 2005/0056122 | A1 | 3/2005 | Belik | |
| 2005/0076744 | A1 | 4/2005 | Pietras et al. | |
| 2005/0077743 | A1 | 4/2005 | Pietras et al. | |
| 2006/0248984 | A1 | 11/2006 | Ge | |
| 2010/0132180 | A1* | 6/2010 | Conquergood | E21B 19/165 29/702 |
| 2011/0017013 | A1* | 1/2011 | Bader | F16H 57/01 74/606 R |
| 2013/0305884 | A1 | 11/2013 | Dobush | |
| 2014/0116687 | A1 | 5/2014 | Ruehmann | |
| 2014/0245867 | A1* | 9/2014 | Ge | E21B 19/168 81/57.33 |
| 2015/0167409 | A1 | 6/2015 | Gerwing et al. | |
| 2015/0240582 | A1 | 8/2015 | Bansal et al. | |
| 2015/0252632 | A1 | 9/2015 | Wentworth et al. | |
| 2016/0333964 | A1 | 11/2016 | Scekic et al. | |
| 2017/0030181 | A1 | 2/2017 | Thomas et al. | |
| 2017/0342785 | A1 | 11/2017 | Kaasin | |
| 2018/0216423 | A1* | 8/2018 | Henriksen | E21B 19/161 |
| 2018/0347294 | A1 | 12/2018 | Vo | |
| 2020/0123985 | A1* | 4/2020 | Lück | F02K 3/06 |
| 2020/0232817 | A1* | 7/2020 | Kichise | B62D 15/0215 |
| 2020/0278193 | A1* | 9/2020 | Orban | G01B 11/2433 |
| 2021/0025252 | A1 | 1/2021 | Magnuson | |

FOREIGN PATENT DOCUMENTS

| | | | |
|---|---|---|---|
| CA | 2484053 | A1 | 4/2005 |
| CA | 2507788 | A1 | 11/2005 |
| CA | 2537698 | C | 5/2009 |
| CA | 2507788 | C | 1/2010 |
| CA | 2484053 | C | 9/2010 |
| CA | 2869240 | A1 | 10/2013 |
| CA | 2817551 | A1 | 11/2013 |
| CA | 2869240 | C | 6/2015 |
| CA | 3010169 | A1 | 1/2020 |
| EP | 1660277 | A2 | 5/2006 |
| EP | 1660277 | A4 | 4/2013 |
| EP | 2825717 | A1 | 1/2015 |
| GB | 2406867 | A | 4/2005 |
| GB | 2414207 | A | 11/2005 |
| GB | 2406867 | B | 11/2006 |
| GB | 2414207 | B | 11/2009 |
| MX | 2006002581 | A | 6/2006 |
| NO | 200601182 | L | 4/2006 |
| NO | 338849 | B1 | 10/2016 |
| WO | 2005/026492 | A2 | 3/2005 |
| WO | 2005/026492 | A3 | 8/2005 |
| WO | 2013/155588 | A1 | 10/2013 |

* cited by examiner

CROSS_SECTIONAL VIEW along line 3-3

D - OD
d - ID
$D_L$ - Major Cone Diameter at Shoulder
$D_{LF}$ - Diameter of Cylinder Section
C - Pitch Diameter at Gage Point
$D_F$ - Bevel Diameter $D_S$ - Small Diameter of Pin
$Q_C$ - Box Counterbore Diameter
$L_{PC}$ - Length of Pin
$L_{BC}$ - Depth of Box
$L_{SC}$ - Box Smooth Counterbore Depth

302

304

| Cone Diameter | Size | Type | OD | Pitch ID | Thread Diameter | Thread per in. | Thread Taper | Bevel Form | box Counter-bore Diameter | box Counter-bore Diameter | Depth of box | Pin Box | Pin Major Cone Length | Pin Cylinder Diameter | Pin Minor Diameter |
|---|---|---|---|---|---|---|---|---|---|---|---|---|---|---|---|
| | | D | d | C | | | | $D_F$ | $Q_c$ | $L_{sc}$ | $L_{BC}$ | $L_{PC}$ | $D_L$ | $D_{LF}$ | $D_s$ |
| in. | | in. | in. | in. | in./ft | | | in. | in. | in. | in. | in. | in. | in. | in. |
| 5 | NC50 | 6 5/8 | 3 3/4 | 5.042 | 4 | 2 | V.038R | 6 1/16 | 5 5/16 | 5/8 | 5 1/8 | 4.500 | 5.250 | 5.125 | 4.500 |
| 5 | H90 | | | 4.908 | 3.5 | 2 | 90V .050 | | 5.171875 | 5/8 | 5.1875 | 4.625 | 5.104 | 4.922 | 4.334 |
| 5 | XH | 6.375 | 3.75 | 5.042 | 4 | 2 | V. 065 | 5.921875 | 5.3125 | 5/8 | 5.125 | 4.500 | 5.25 | 5.125 | 4.5 |
| 5 1/2 | H90 | | | 5.179 | 3 1/2 | 2 | 90V .050 | - | 5 7/16 | 5/8 | 5 7/16 | 4.625 | 5.375 | 5.188 | 4.604 |
| 5 1/2 | API REG. | 6 3/4 | 2 3/4 | 5.234 | 4 | 3 | V. 050 | 6 15/32 | 5 37/64 | 5/8 | 5 3/8 | 4.750 | 5.520 | - | 4.328 |
| 5 1/2 | FH | 7 | 4 | 5.591 | 4 | 2 | V. 050 | 6 23/32 | 5 29/32 | 5/8 | 5 3/8 | 5 | 5.825 | - | 5.000 |
| 5 1/2 | NC56 | 7 | 3 3/4 | 5.616 | 4 | 3 | V. 038R | 6 47/64 | 5 15/16 | 5/8 | 5 3/8 | 5 | 5.876 | 5.703 | 4.626 |
| 5 1/2 | IF | 7 3/8 | 4 13/16 | 6.189 | 4 | 2 | V. 065 | 7 9/64 | 6 29/64 | 5/8 | 5 3/8 | 5 | 6.397 | - | 5.562 |
| 6 5/8 | API REG. | 7 3/4 | 3 1/2 | 5.758 | 4 | 2 | V. 050 | 7 21/64 | 6 1/16 | 5/8 | 5 3/8 | 5 | 5.992 | | 5.156 |
| 6 5/8 | H90 | | | 5.804 | 3 1/2 | 2 | 90V .050 | | 6 1/4 | 5/8 | 5 11/16 | 4.875 | 6.000 | 5.813 | 5.188 |
| 6 5/8 | NC61 | 8 1/4 | 3 | 6.178 | 4 | 3 | V. 038R | 7 13/16 | 6 1/2 | 5/8 | 6 1/8 | 5.500 | 6.438 | 6.266 | 5.063 |
| 6 5/8 | FH | 8 | 5 | 6.520 | 4 | 2 | V. 050 | 7 45/64 | 6 27/32 | 5/8 | 5 3/8 | 5 | 6.753 | | 5.921 |
| 6 5/8 | IF | 8 1/2 | 5 29/32 | 8.251 | 4 | 2 | V. 065 | 8 1/4 | 7 33/64 | 5/8 | 5 3/8 | 5 | 7.458 | 7.343 | 6.626 |
| 7 | H90 | | | 6.252 | 3 1/2 | 3 | 90V .050 | | 7 1/8 | 13/32 | 5 13/16 | 5.375 | 6.500 | 6.375 | 5.156 |
| 7 5/8 | API REG. | 8 7/8 | 4 | 6.715 | 4 | 3 | V. 050 | 8 7/16 | 7 3/32 | 5/8 | 5 7/8 | 5.250 | 7.000 | | 5.688 |
| 7 5/8 | NC70 | 9 1/2 | 3 | 7.053 | 4 | 3 | V. 038R | 8 31/32 | 7 3/8 | 5/8 | 6 5/8 | 6 | 7.313 | 7.141 | 5.813 |
| 7 5/8 | H90 | | | 7.141 | 3 1/2 | 3 | 90V .050 | | 8 | 13/32 | 6 9/16 | 6 | 7.389 | 7.264 | 5.889 |
| 8 5/8 | API REG. | 10 | 4 3/4 | 7.666 | 4 | 3 | V. 050 | 9 33/64 | 8 3/64 | 5/8 | 6 | 5.375 | 7.951 | | 6.609 |
| 8 5/8 | NC77 | 10 | 3 | 7.741 | 4 | 3 | V. 038R | 9 11/32 | 8 1/16 | 5/8 | 7 1/8 | 6.500 | 8.000 | 7.828 | 6.376 |
| 8 5/8 | H90 | | | 8.016 | 3 1/2 | 3 | 90V .050 | | 9 3/8 | 13/32 | 7 1/16 | 6.500 | 8.264 | 8.139 | 6.639 |

FIG.6B

306

304

| Pipe Size | | TJ | TJ Dia | | Pin Length ($L_{PC}$) | | Threads per inch (TH) | Pin in Box Setdown Depth (L2) | | Minimum Setdown Offset (MSO) | | Setdown Offset | | GAP (L1) | | REVS ($R_{54}$) | Max REVS ($R_{MAX}$) |
|---|---|---|---|---|---|---|---|---|---|---|---|---|---|---|---|---|---|
| in | mm | | in | mm | in | mm | # | in | mm | in | mm | in | mm | in | mm | calc (AF2) | +.5 rev |
| 5 | 127 | NC50 | 6.625 | 168.275 | 4.5 | 114.300 | 2 | 3.53 | 89.65 | 3.14 | 79.65 | 3.92 | 99.65 | 1.36 | 34.65 | 2.73 | 3.23 |
| 5 | 127 | H90 | 0.000 | 0.000 | 4.625 | 117.475 | 2 | 3.54 | 90.03 | 3.15 | 80.03 | 3.94 | 100.03 | 1.47 | 37.45 | 2.95 | 3.45 |
| 5 | 127 | XH | 6.375 | 161.925 | 4.500 | 114.300 | 2 | 3.53 | 89.65 | 3.14 | 79.65 | 3.92 | 99.65 | 1.36 | 34.65 | 2.73 | 3.23 |
| 5 1/2 | 139.7 | H90 | 0 | 0.000 | 4.625 | 117.475 | 2 | 3.52 | 89.51 | 3.13 | 79.51 | 3.92 | 99.51 | 1.49 | 37.96 | 2.99 | 3.49 |
| 5 1/2 | 139.7 | API REG. | 6.75 | 171.450 | 4.75 | 120.650 | 3 | 3.47 | 88.16 | 3.08 | 78.16 | 3.86 | 98.16 | 1.67 | 42.49 | 5.02 | 5.52 |
| 5 1/2 | 139.7 | FH | 7 | 168.275 | 5 | 127.000 | 2 | 3.98 | 101.08 | 3.59 | 91.08 | 4.37 | 111.08 | 1.41 | 35.92 | 2.83 | 3.33 |
| 5 1/2 | 139.7 | NC56 | 7 | 177.800 | 5 | 127.000 | 3 | 3.52 | 89.48 | 3.13 | 79.48 | 3.92 | 99.48 | 1.87 | 47.52 | 5.61 | 6.11 |
| 5 1/2 | 139.7 | IF | 7.375 | 187.325 | 5 | 127.000 | 2 | 3.73 | 94.94 | 3.34 | 84.84 | 4.13 | 104.84 | 1.66 | 42.16 | 3.32 | 3.82 |
| 6 5/8 | 168.28 | API REG | 7.75 | 196.850 | 5 | 127.000 | 2 | 3.92 | 99.54 | 3.53 | 89.54 | 4.31 | 109.54 | 1.47 | 37.46 | 2.95 | 3.45 |
| 6 5/8 | 168.28 | H90 | 0 | 0.000 | 4.875 | 123.825 | 2 | 4.29 | 108.93 | 3.89 | 98.93 | 4.68 | 118.93 | 0.98 | 24.90 | 1.96 | 2.46 |
| 6 5/8 | 168.28 | NC61 | 8.25 | 209.550 | 5.5 | 139.700 | 3 | 3.77 | 95.67 | 3.37 | 85.67 | 4.16 | 105.67 | 2.13 | 54.03 | 6.38 | 6.88 |
| 6 5/8 | 168.28 | FH | 8 | 203.200 | 5 | 127.000 | 2 | 3.99 | 101.47 | 3.60 | 91.47 | 4.39 | 111.47 | 1.40 | 35.53 | 2.80 | 3.30 |
| 6 5/8 | 168.28 | IF | 8.5 | 215.900 | 5 | 127.000 | 2 | 3.74 | 94.96 | 3.34 | 84.96 | 4.13 | 104.96 | 1.66 | 42.04 | 3.31 | 3.81 |
| 7 | 177.8 | H90 | 0 | 0.000 | 5.375 | 136.525 | 3 | 4.89 | 124.25 | 4.50 | 114.25 | 5.29 | 134.25 | 0.88 | 22.27 | 2.63 | 3.13 |
| 7 5/8 | 193.68 | API REG | 8.875 | 225.425 | 5.25 | 133.350 | 3 | 3.79 | 96.27 | 3.40 | 86.27 | 4.18 | 106.27 | 1.85 | 47.08 | 5.56 | 6.06 |
| 7 5/8 | 193.68 | NC70 | 9.5 | 241.300 | 6 | 152.400 | 3 | 4.01 | 101.86 | 3.62 | 91.86 | 4.40 | 111.86 | 2.38 | 60.54 | 7.15 | 7.65 |
| 7 5/8 | 193.68 | H90 | 0 | 0.000 | 6 | 152.400 | 3 | 5.16 | 130.97 | 3.76 | 120.97 | 5.55 | 140.97 | 1.24 | 31.43 | 3.71 | 4.21 |
| 8 5/8 | 219.08 | API REG | 10 | 254.000 | 5.375 | 136.525 | 3 | 3.86 | 97.94 | 3.46 | 87.94 | 4.25 | 107.94 | 1.91 | 48.59 | 5.74 | 6.24 |
| 8 5/8 | 219.08 | NC77 | 10 | 254.000 | 6.5 | 165.100 | 3 | 4..25 | 108.06 | 3.88 | 98.06 | 4.65 | 118.06 | 2.64 | 67.04 | 7.92 | 8.42 |
| 8 5/8 | 219.08 | H90 | 0 | 0.000 | 6.5 | 165.100 | 3 | 6.46 | 164.12 | 6.67 | 154.12 | 6.86 | 174.12 | 0.43 | 10.98 | 1.30 | 1.80 |

*FIG.7*

SPINNER WEAR DETECTION

CROSS-REFERENCE TO RELATED APPLICATION(S)

This application claims priority under 35 U.S.C. § 119(e) to U.S. Patent Application No. 62/951,948 entitled "SPINNER WEAR DETECTION," by Christopher MAGNUSON, filed Dec. 20, 2019, which application is assigned to the current assignee hereof and incorporated herein by reference in its entirety.

TECHNICAL FIELD

The present invention relates, in general, to the field of drilling and processing of wells. In particular, present embodiments relate to a system and method for operating robotic systems during subterranean operations. More particularly, present embodiments relate to detecting the wear of spinners in an iron roughneck during subterranean operations.

BACKGROUND

When a rig is tripping a tubular string into a wellbore, an iron roughneck can be used to connect tubulars at their threaded ends and wrench the connection to a desired torque to maintain the connection. The connection may require rotating one tubular relative to the other tubular to thread the ends together (e.g. pin end being threaded into a box end). This "spinning" can be performed by a spinner assembly of the iron roughneck. When the ends have been threaded together (i.e. tubulars connected), wrench assemblies of the iron roughneck can be used to clamp the tubulars and torque the tubulars relative to each other to obtain the desired torque for the tubular connection.

When a rig is tripping a tubular string out of a wellbore, an iron roughneck can be used to disconnect tubulars at their threaded ends by applying a desired torque and "breaking" (or releasing) a connection between the tubulars with one of the tubulars being spun out of (e.g. unthreaded from) the other tubular. Spinning the tubular out of the other tubular may require rotating one tubular relative to the other tubular to unthread the ends (e.g. pin end being unthreaded from a box end). Again, this "spinning" can be performed by a spinner assembly of the iron roughneck. When the ends have been unthreaded (i.e. tubulars disconnected), a pipe handler can move the tubular, which is released from the tubular string to a storage location on or off the rig.

In both the tripping in or tripping out, the iron roughneck can engage and rotate tubulars to thread or unthread the tubulars. As mentioned above, some iron roughnecks can use the spinner assembly to engage a tubular body of one of the tubulars being connected or disconnected and rotate the tubular at a faster speed than the wrench assemblies. The wrench assemblies (or clamping mechanisms) are included in a wrench assembly and are used to torque and untorque tubular connections. The spinner assembly can have a plurality of spinners, each of which can be cylindrically shaped with a gripping surface on its outer perimeter. The iron roughneck can move the spinners into and out of engagement with the tubular, with engagement of the tubular being provided by an outer gripping surface of each spinner that can grip the body of the tubular and transmit rotational motion of the spinner to the tubular body, thereby spinning the tubular. Over time, these gripping surfaces can become worn thereby causing the spinning assembly to slip on the tubular body and reduce the amount of rotational force that is applied to the tubular body. Continued use of the spinners can degrade the performance of the gripping surfaces to a point that the spinner assembly may fail to perform the task of connecting or disconnecting tubulars.

Therefore, spinners can be seen as consumables that are replaced periodically to maintain the performance of the spinner assembly. However, replacement of the spinners is generally performed periodically as described in a maintenance plan. The period of time between replacement of the spinners can usually be set to ensure that the spinners are replaced well before the time they are actually beginning to show symptoms of wear. Therefore, the spinners can be replaced before they have outlived their usefulness, thus increasing costs due to increased replacement cycles and increased down time.

Therefore, improvements of robotic rig systems are continually needed, and particularly improvements for spinner assemblies of iron roughnecks used in support of subterranean operations.

SUMMARY

In accordance with an aspect of the disclosure, a system that can include a spinner assembly comprising an encoder, and a spinner subassembly, the spinner subassembly comprising, a spinner configured to engage a tubular, and a drive gear coupled to the spinner, with the drive gear configured to drive rotation of the spinner, and the encoder configured to count teeth of the drive gear as the drive gear rotates.

In accordance with another aspect of the disclosure, a system that can include a spinner subassembly comprising, a plurality of spinners configured to engage and rotate a tubular, a drive gear that is coupled to the plurality of spinners, with the drive gear configured to rotate the plurality of spinners, a proximity sensor configured to detect teeth of the drive gear as the teeth pass through a sensing field of the proximity sensor, and a controller configured to receive first sensor data from the proximity sensor, wherein the first sensor data is representative of an actual number of revolutions of the plurality of spinners when the plurality of spinners engages the tubular.

In accordance with another aspect of the disclosure, a method that can include operations for engaging a tubular with a spinner, rotating a drive gear, with the drive gear coupled to the spinner, rotating the spinner in response to rotating the drive gear, rotating the tubular in response to rotating the spinner, and counting, via an encoder, teeth of the drive gear as the teeth pass through a sensing field of a proximity sensor.

BRIEF DESCRIPTION OF THE DRAWINGS

These and other features, aspects, and advantages of present embodiments will become better understood when the following detailed description is read with reference to the accompanying drawings in which like characters represent like parts throughout the drawings, wherein:

FIGS. 6A and 6B are a representative table including specifications for example tubulars, in accordance with certain embodiments;

FIG. 7 is a representative table including maximum revolution calculations for spinning a tubular in a joint connection of a tubular string, in accordance with certain embodiments;

DETAILED DESCRIPTION

Present embodiments provide a robotic system with electrical components that can operate in hazardous zones (such as a rig floor) during subterranean operations. The robotic system can include a robot and a sealed housing that moves with the robot, with electrical equipment and/or components contained within the sealed housing. The aspects of various embodiments are described in more detail below.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

The use of the word "about", "approximately", or "substantially" is intended to mean that a value of a parameter is close to a stated value or position. However, minor differences may prevent the values or positions from being exactly as stated. Thus, differences of up to ten percent (10%) for the value are reasonable differences from the ideal goal of exactly as described. A significant difference can be when the difference is greater than ten percent (10%).

Figure 1A:
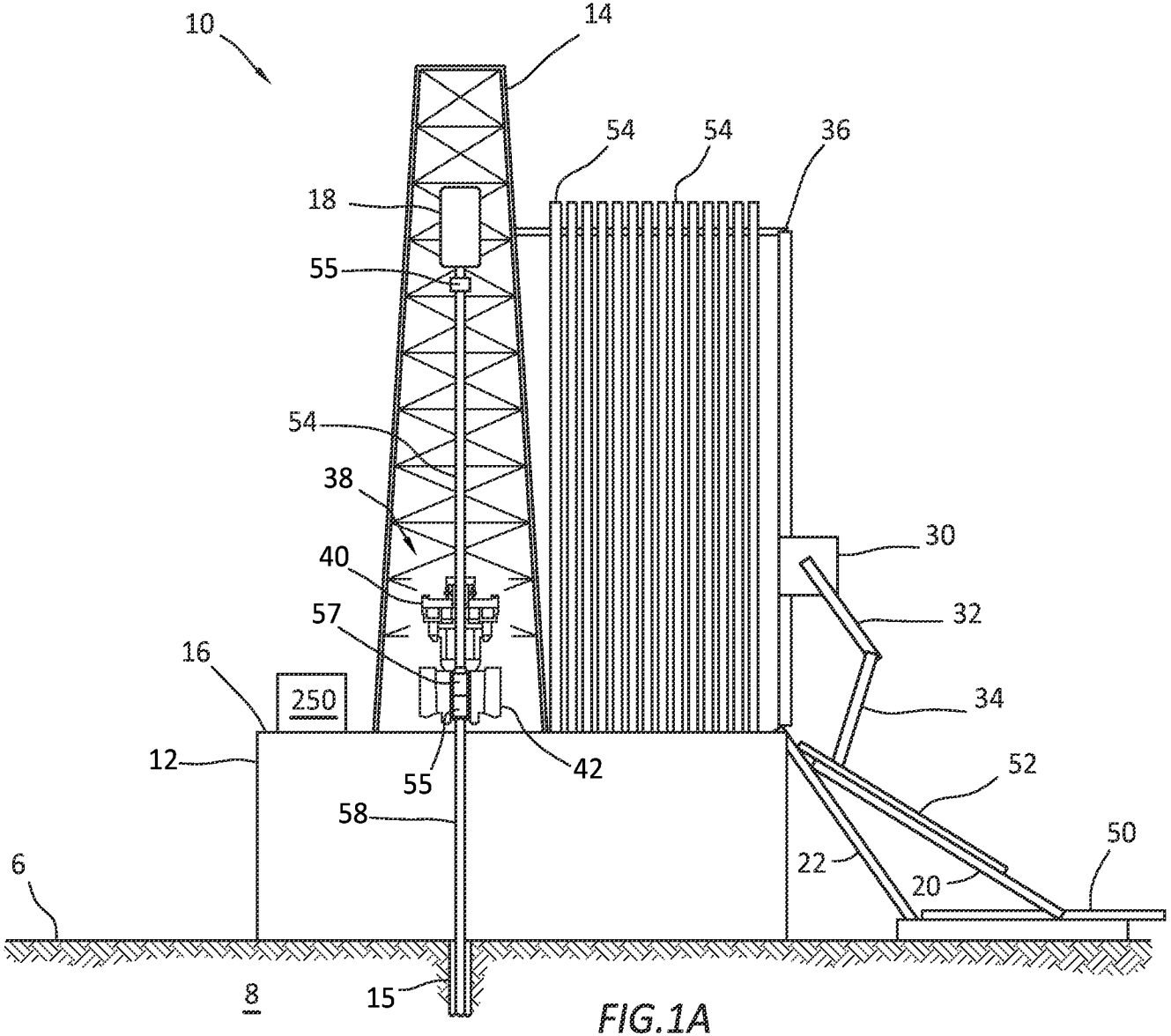
FIG. 1A is a representative simplified front view of a rig being utilized for a subterranean operation, in accordance with certain embodiments.

FIG. 1A is a representative simplified front view of a rig 10 being utilized for a subterranean operation (e.g. tripping in or out a tubular string to or from a wellbore), in accordance with certain embodiments. The rig 10 can include a platform 12 with a rig floor 16 and a derrick 14 extending up from the rig floor 16. The derrick 14 can provide support for hoisting the top drive 18 as needed to manipulate tubulars. A catwalk 20 and V-door ramp 22 can be used to transfer horizontally stored tubular segments 50 to the rig floor 16. A tubular segment 52 can be one of the horizontally stored tubular segments 50 that is being transferred to the rig floor 16 via the catwalk 20. A pipe handler 30 with articulating arms 32, 34 can be used to grab the tubular segment 52 from the catwalk 20 and transfer the tubular segment 52 to the top drive 18, the fingerboard 40, the wellbore 15, etc. However, it is not required that a pipe handler 30 be used on the rig 10. The top drive 18 can transfer tubulars directly to and directly from the catwalk 20 (e.g. using an elevator coupled to the top drive). As used herein, "tubular" refers to an elongated cylindrical tube and can include any of the tubulars manipulated around the rig 10, such as tubular segments 50, 52, tubular stands, tubulars 54, and tubular string 58, but not limited to the tubulars shown in FIG. 1A. Therefore, in this disclosure, "tubular" is synonymous with "tubular segment," "tubular stand," and "tubular string," as well as "pipe," "pipe segment," "pipe stand," "pipe string," "casing," "casing segment," or "casing string."

The tubular string 58 can extend into the wellbore 15, with the wellbore 15 extending through the surface 6 into the subterranean formation 8. When tripping the tubular string 58 into the wellbore 15, tubulars 54 are sequentially added to the tubular string 58 to extend the length of the tubular string 58 into the earthen formation 8. FIG. 1A shows a land-based rig. However, it should be understood that the principles of this disclosure are equally applicable to offshore rigs where "off-shore" refers to a rig with water between the rig floor and the earth surface 6.

When tripping the tubular string 58 out of the wellbore 15, tubulars 54 are sequentially removed from the tubular string 58 to reduce the length of the tubular string 58 in the wellbore 15. The pipe handler 30 can be used to remove the tubulars 54 from an iron roughneck 38 or a top drive 18 at a well center 24 (see FIG. 1B) and transfer the tubulars 54 to the catwalk 20, the fingerboard 36, etc. The iron roughneck 38 can break a threaded connection between a tubular 54 being removed and the tubular string 58. A spinner assembly 40 can engage a body of the tubular 54 to spin a pin end 57 of the tubular 54 out of a threaded box end 55 of the tubular string 58, thereby unthreading the tubular 54 from the tubular string 58.

When tripping the tubular string 58 into the wellbore 15, tubulars 54 are sequentially added to the tubular string 58 to increase the length of the tubular string 58 in the wellbore 15. The pipe handler 30 can be used to deliver the tubulars 54 to a well center on the rig floor 16 in a vertical orientation and hand the tubulars 54 off to an iron roughneck 38 or a top drive 18. The iron roughneck 38 can make a threaded connection between the tubular 54 being added and the tubular string 58. A spinner assembly 40 can engage a body of the tubular 54 to spin a pin end 57 of the tubular 54 into a threaded box end 55 of the tubular string 58, thereby threading the tubular 54 into the tubular string 58. The wrench assembly 42 can provide a desired torque to the threaded connection, thereby completing the connection.

A rig controller 250 can be used to control the rig 10 operations including controlling various rig equipment, such as the pipe handler 30, the top drive 18, the iron roughneck 38, the fingerboard equipment, imaging systems, various other robots on the rig 10 (e.g. a drill floor robot). The rig controller 250 can control the rig equipment autonomously (e.g. without periodic operator interaction), semi-autonomously (e.g. with limited operator interaction such as initiating a subterranean operation, adjusting parameters during the operation, etc.), or manually (e.g. with the operator interactively controlling the rig equipment via remote control interfaces to perform the subterranean operation).

The rig controller 250 can include one or more processors with one or more of the processors distributed about the rig 10, such as in an operator's control hut, in the pipe handler 30, in the iron roughneck 38 (e.g. controller 130, see FIG. 1B), in the fingerboard 36, in the imaging systems, in various other robots, in the top drive 18, at various locations on the rig floor 16 or the derrick 14 or the platform 12, at a remote location off of the rig 10, at downhole locations, etc. It should be understood that any of these processors can perform control or calculations locally or can communicate to a remotely located processor for performing the control or calculations. These processors can be coupled via a wired or wireless network.

Figure 1B:
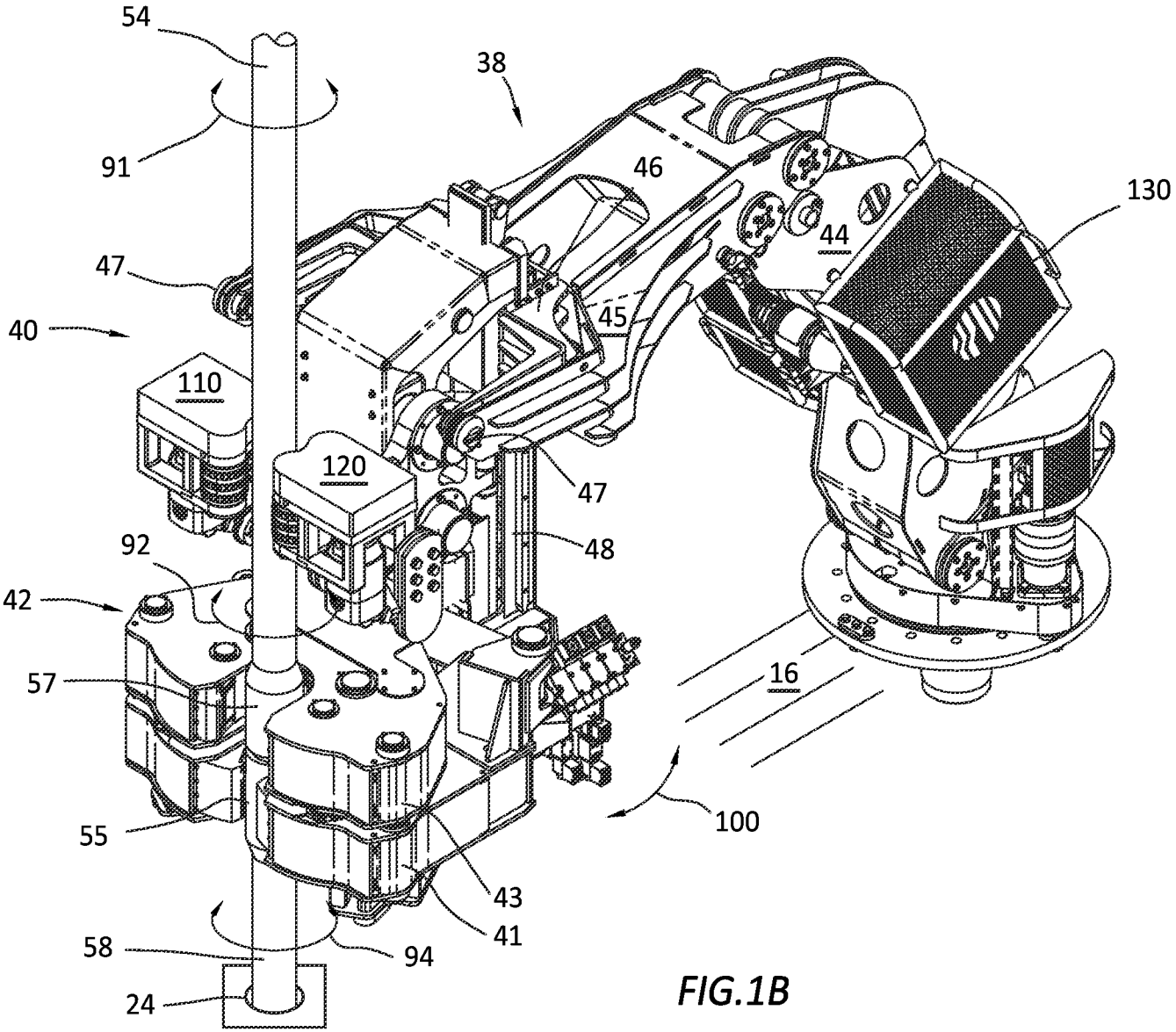
FIG. 1B is a representative perspective view of an iron roughneck with a spinner assembly on a rig floor, in accordance with certain embodiments.

FIG. 1B is a representative perspective view of an iron roughneck 38 with a spinner assembly 40 on a rig floor 16 with a body of the tubular 54 engaged with the spinner assembly 40 and the wrench assembly 42 gripping both the box end 55 of the tubular string 58 and the pin end 57 of the tubular 54. The iron roughneck 38 can include a robot arm 44 that supports the iron roughneck 38 from the rig floor 16. The robotic arm 44 can include a support arm 45 that can couple to a frame 48 via a frame arm 46. The support arm 45 can support and lift the frame 48 of the iron roughneck 38 via the frame arm 46, which can be rotationally coupled to the support arm 45 via the pivots 47. The frame 48 can provide structural support for the spinner assembly 40 and the wrench assembly 42. The robotic arm 44 can move the frame 48 from a retracted position (i.e. away from the well center 24) to an extended position (i.e. toward the well center 24) and back again as needed to provide support for making or breaking connections in the tubular string 58. In the extended position of the frame 48, the spinner assembly 40 and the wrench assembly 42 can engage the tubular 54 and the tubular string 58.

The top drive 18 (not shown) can rotate the tubular string 58 in either clockwise or counter-clockwise directions as shown by arrows 94. The tubular string 58 is generally rotated in a direction that is opposite the direction used to unthread tubular string 58 connections. When a connection is to be made or broken, a first wrench assembly 41 of the wrench assembly 42 can grip the box end 55 of the tubular string 58. The first wrench assembly 41 can prevent further rotation of the tubular string 58 by preventing rotation of the box end 55 of the tubular string 58.

If a connection is being made, the spinner assembly 40 can engage the tubular 54 at a body portion, which is the portion of the tubular between the pin end 57 and box end 55 of the tubular 54. With the pin end 57 of the tubular 54 engaged with the box end 55 of the tubular string 58, the spinner assembly 40 can rotate the tubular 54 in a direction (arrows 91) to thread the pin end 57 of the tubular 54 into the box end 55 of the tubular string 58, thereby forming a connection of the tubular 54 to the tubular string 58. When a pre-determined torque of the connection is reached by the spinner assembly 40 rotating the tubular 54 (arrows 91), then a second wrench assembly 43 of the wrench assembly 42 can grip the pin end 57 of the tubular 54 and rotate the pin end 57. By rotating the second wrench assembly 43 relative to the first wrench assembly 41 (arrows 92), the wrench assembly 42 can torque the connection to a desired torque, thereby completing the connection of the tubular 54 to the tubular string 58. The iron roughneck can then be retracted from the well center 24 and the subterranean operation can continue.

If a connection is being broken, the spinner assembly 40 can engage the tubular 54 at the body portion. The first wrench assembly 41 can grip the box end 55 of the tubular string 58 and the second wrench assembly 43 can grip the pin end 57 of the tubular 54. By rotating the pin end 57 of the tubular 54 relative to the box end 55 of the tubular string 58, the previously torqued connection can be broken loose. After the connection is broken, the spinner assembly 40 can rotate the tubular 54 relative to the tubular string 58 (arrows 91), thereby releasing the tubular 54 from the tubular string 58. The tubular 54 can then be removed from the well center by the top drive 18 or pipe handler 30 (or other means) and the iron roughneck 38 can be retracted from the well center 24 to allow the top drive 18 access to the top end of the tubular string 58 for hoisting another length of the tubular string 58 from the wellbore 15 to remove another tubular 54.

The position of the spinner assembly 40 and wrench assembly 42 relative to the rig floor 16 (and thus the tubular string 58) can be controlled by the controller 250 via the robotic arm 44 and the frame arm 46, which is moveable relative to the frame 48. The controller 250 or other controllers, via the robotic arm 44, can manipulate the frame 48 by lifting, lowering, extending, retracting, rotating the arm, etc. The robotic arm 44 can be coupled to the frame 48 via the support arm 45 which can be rotatably coupled to the frame arm 46 via pivots 47. The frame 48 can move up and down relative to the frame arm 46 to raise and lower the spinner assembly 40 and wrench assembly 42 as needed to position the assemblies 40, 42 relative to the tubular string 58. The frame 48 can also tilt (arrows 100) via pivots 47 to longitudinally align a center axis 102 (see FIG. 2B) of the assemblies 40, 42 relative to the tubular string 58.

Figure 1C:
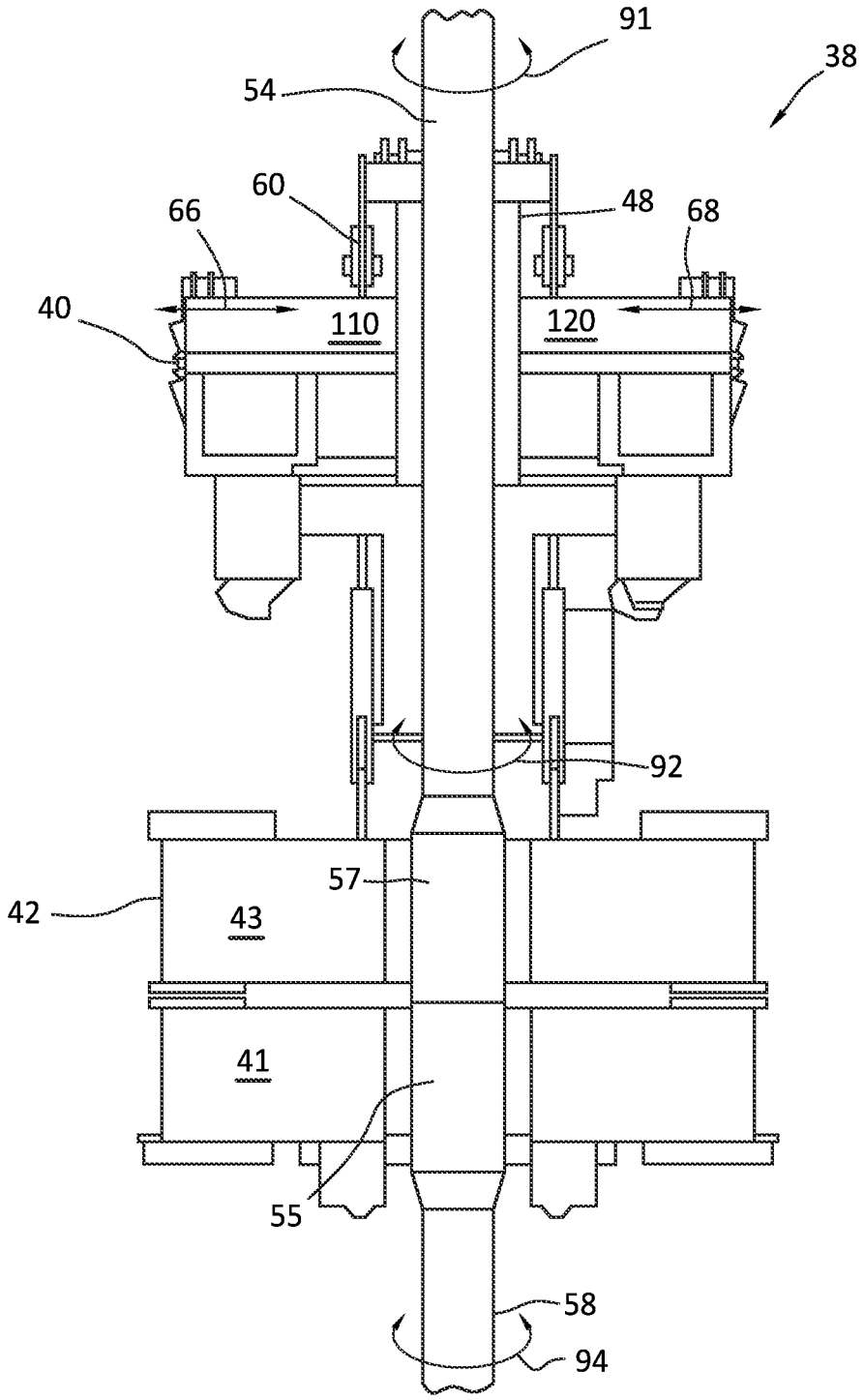
FIG. 1C is a representative front view of an iron roughneck engaging a tubular string, in accordance with certain embodiments.

FIG. 1C is a representative front view of an iron roughneck 38 engaging a tubular string 58. As described above regarding FIG. 1B, the spinner assembly 40 and the wrench assembly 42 can be structurally supported by the frame 48. The wrench assembly 42 can include a first wrench assembly 41 (or backup wrench assembly) that can grip an end of the tubular string 58 (e.g. the box end 55), thereby preventing rotation of the tubular string 58 (arrows 94). The second wrench assembly 43 (or torque wrench assembly) can grip an end of the tubular 54 (e.g. the pin end 57) and torque the connection (arrows 92) relative to the tubular string 58 as needed to make or break the connection. However, it should be understood that both wrench assemblies 41, 43 can rotate to make or break the connection.

The spinner assembly 40 can include spinner subassemblies 110, 120 that can cooperate with each other to engage and rotate the tubular 54. The spinner assembly 40 can include a coupling assembly 60 that couples the spinner subassemblies 110, 120 together and couples the spinner subassemblies 110, 120 to the frame 48. The coupling assembly 60 can operate to move the spinner subassemblies 110, 120 toward or away (arrows 66, 68) from each other to engage or disengage the spinner subassemblies 110, 120 with the tubular 54.

Figure 2A:
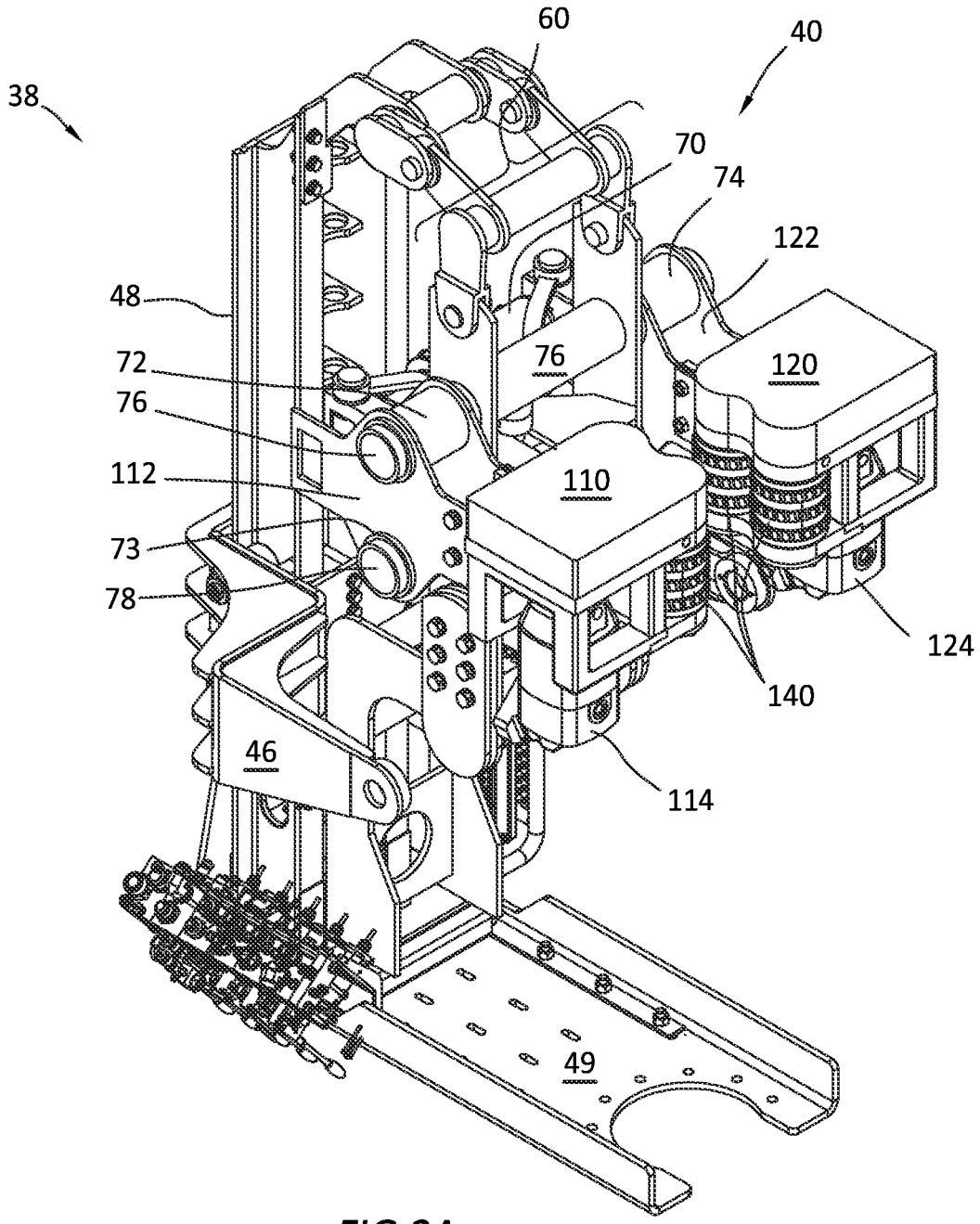
FIG. 2A is a representative perspective view of an iron roughneck with a wrench assembly portion removed for clarity, in accordance with certain embodiments.

FIG. 2A is a representative perspective view of an iron roughneck 38 with the wrench assembly 42 portion removed for clarity. The iron roughneck 38 can include the frame 48 that supports the spinner assembly 40 and the wrench assembly 42 (not shown). A base 49 of the frame 48 can be used to support the wrench assembly 42.

The coupling assembly 60 can include guide tubes 76, 78. Bracket assembly 112 can mount the spinner subassembly 110 to the guide tubes 76, 78 via a pair of sleeves 72, 73. The sleeve 72 can be coaxially mounted over one end of the guide tube 76, and the sleeve 73 can be coaxially mounted over one end of the guide tube 78. Bracket assembly 122 can mount the spinner subassembly 120 to the guide tubes 76, 78 via a pair of sleeves 74, 75 (sleeve 75 not shown, see FIG. 3). The sleeve 74 can be coaxially mounted over another end of the guide tube 76, and the sleeve 75 can be coaxially mounted over another end of the guide tube 78. The sleeves 72, 74 and sleeves 73, 75 are configured to slide along the respective guide tubes 76, 78. An actuator 70 is configured to cause the bracket assemblies 112, 122 to move toward or away from each other.

The bracket assembly 112 can be fixedly attached to the spinner subassembly 110, such that the spinner subassembly 110 moves with the sleeves 72, 73 when the sleeves 72, 73 are slide along the respective guide tubes 76, 78. The bracket assembly 122 can be fixedly attached to the spinner subassembly 120, such that the spinner subassembly 120 moves with the sleeves 74, 75 when the sleeves 74, 75 are slide along the respective guide tubes 76, 78. Therefore, when the sleeves 72, 73 are moved toward the sleeves 74, 75 along the respective guide tubes 76, 78, then the spinner subassemblies 110, 120 are moved toward each other. When the sleeves 72, 73 are moved away from the sleeves 74, 75 along the respective guide tubes 76, 78, then the spinner subassemblies 110, 120 are moved away from each other. The movements of the spinner subassemblies 110, 120 are parallel to the movements of the sleeves 72, 73, 74, 75, and offset from the movements of the sleeves 72, 73, 74, 75. Therefore, the travel directions for the subassemblies 110, 120, and the travel directions for the sleeves 72, 73, 74, 75 are parallel to each other but spaced away from each other. In other words, movements of the sleeves 72, 73, 74, 75 are not in line with movements of the subassemblies 110, 120.

Each spinner subassembly 110, 120 can include a motor 114, 124, respectively, and multiple spinners 140. The motor 114, 124 can rotate respective spinners 140, and when the spinner subassemblies 110, 120 are engaged with the tubular 54, rotation of the spinners 140 can cause the tubular 54 to rotate.

Figure 2B:
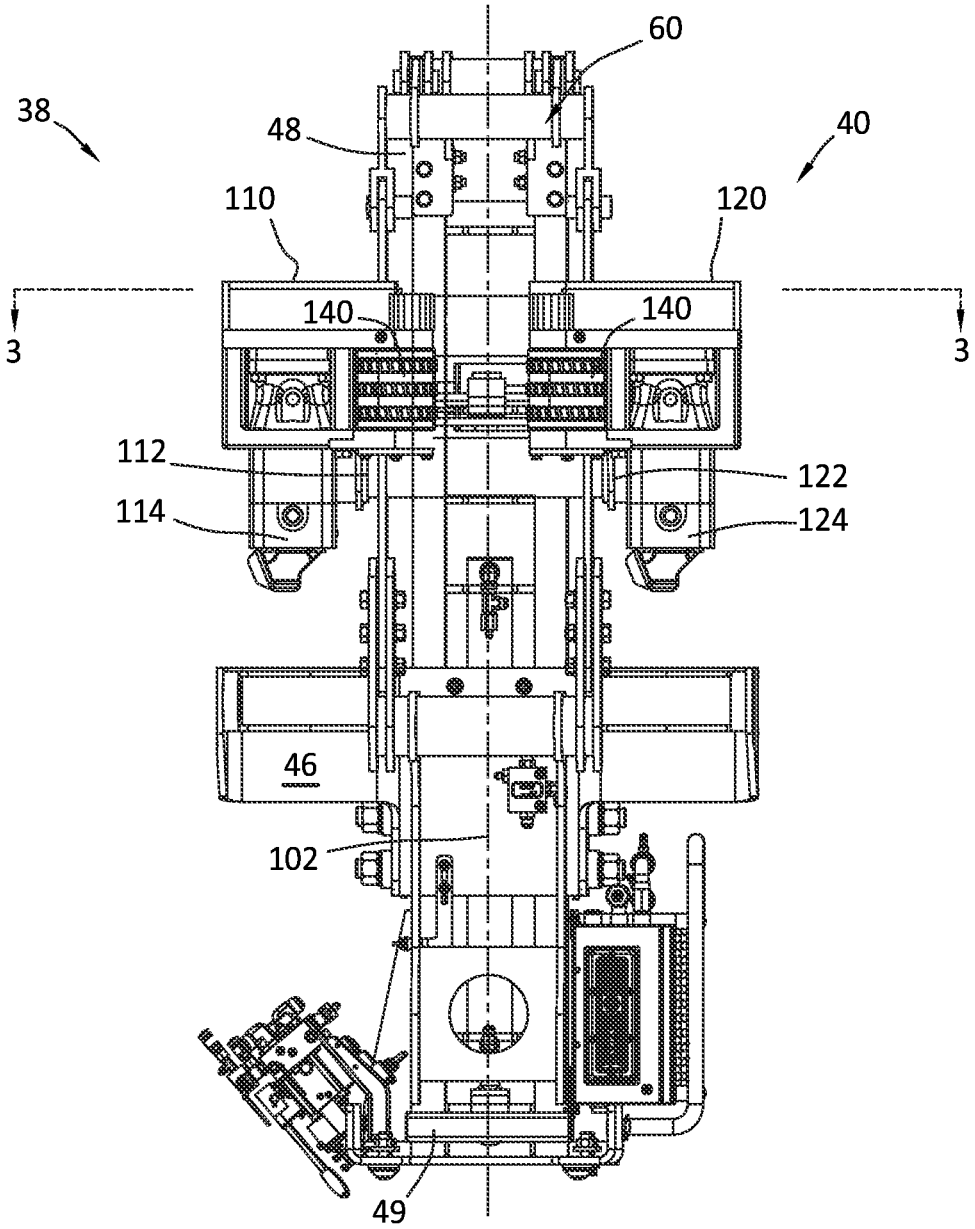
FIG. 2B is a representative front view of an iron roughneck with a wrench assembly portion removed for clarity, in accordance with certain embodiments.

FIG. 2B is a representative front view of an iron roughneck 38 with a wrench assembly portion 42 removed for clarity. The spinner subassemblies 110, 120 are positioned on opposite sides of a center axis 102 of the spinner assembly 40, with the center axis 102 being positioned between the spinner subassemblies 110, 120.

Figure 3:
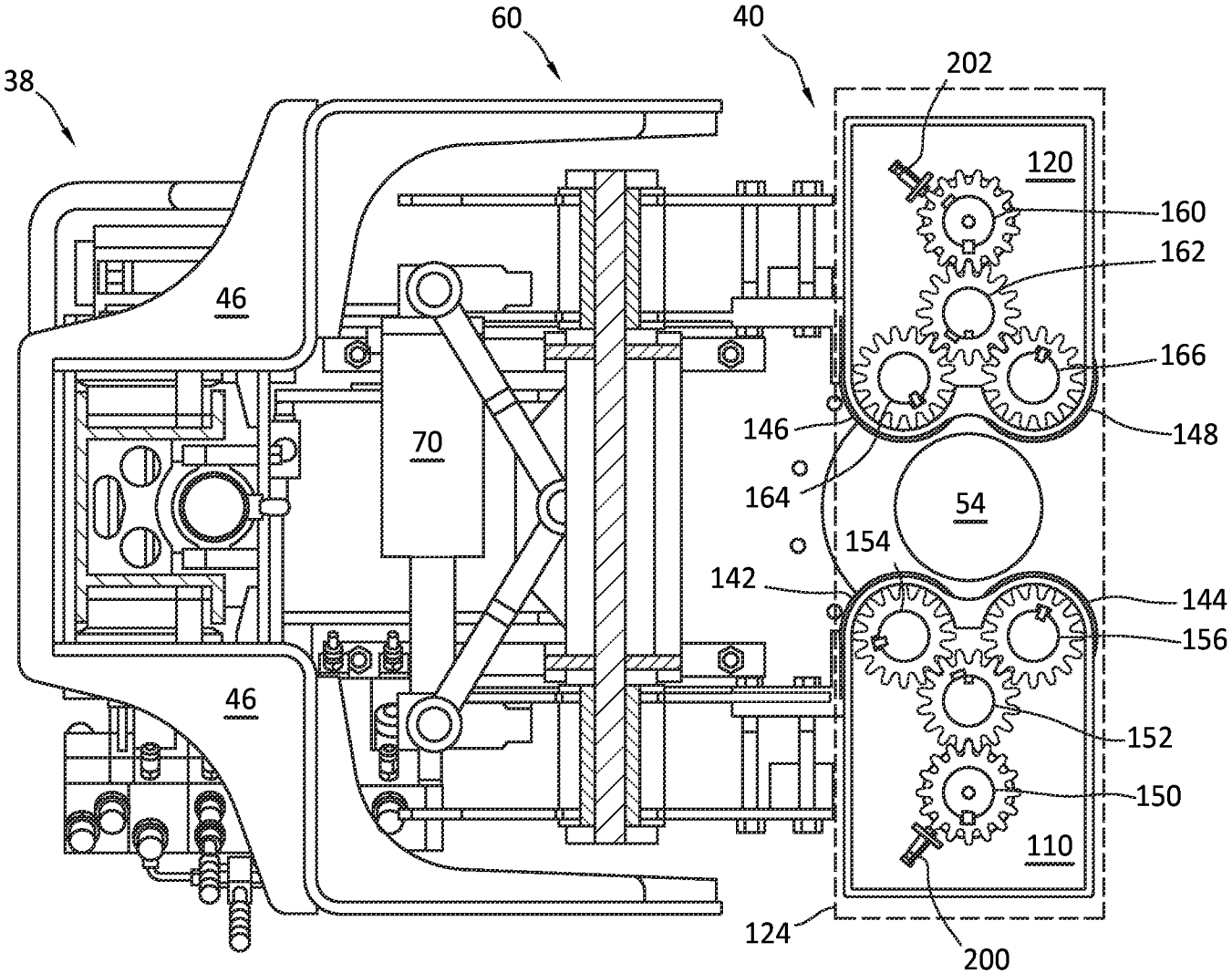
FIG. 3 is a representative partial cross-sectional view of the roughneck along line 3-3 as indicated in FIG. 2B, in accordance with certain embodiments.
Figure 4A:
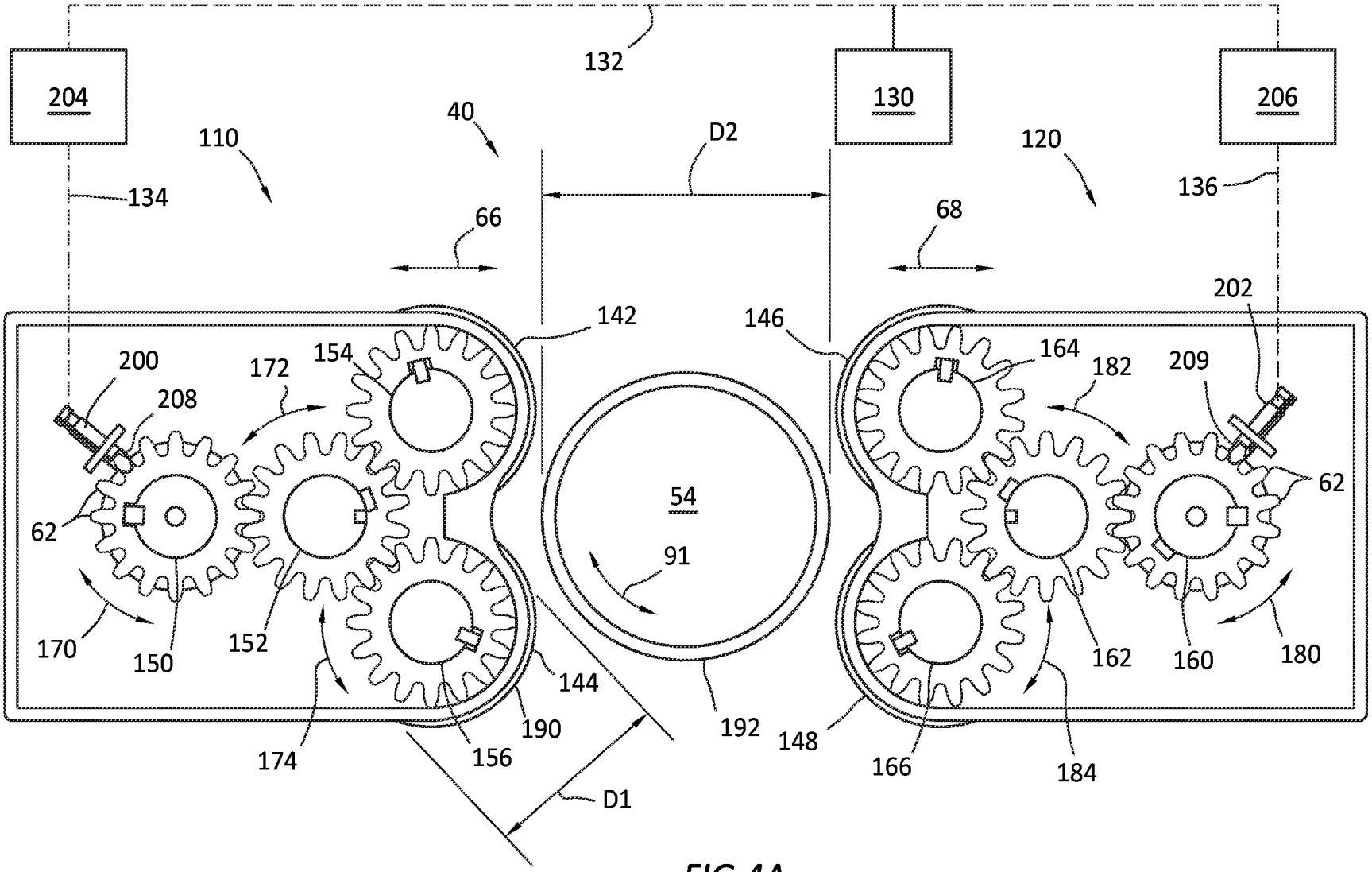
FIGS. 4A and 4B are representative partial cross-sectional views of the spinner assembly along line 3-3 as indicated in FIG. 2B, in accordance with certain embodiments.
Figure 4B:
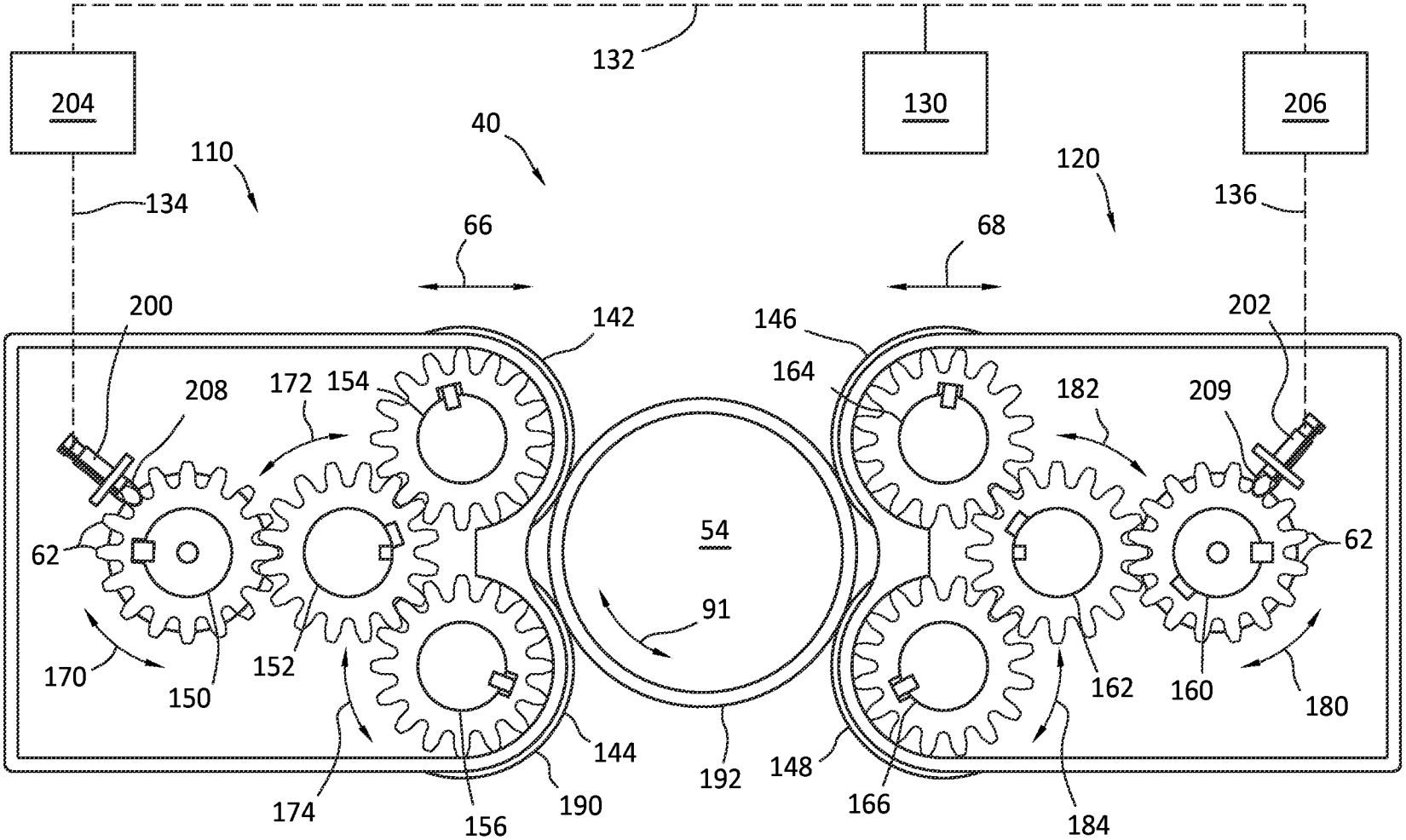

FIGS. 3, 4A, 4B are representative partial cross-sectional views of the roughneck 36 along line 3-3 as indicated in FIG. 2B. FIG. 3 shows a representative partial cross-sectional view of the iron roughneck 38 that reveals the gears 150, 152, 154, 156 of the spinner subassembly 110 and the gears 160, 162, 164, 166 of the spinner subassembly 120. FIG. 3 also shows an actuator 70 coupled to the spinner subassemblies 110, 120 via the linkage assembly 60. The actuator 70 can cause the spinner subassemblies 110, 120 to move toward or away from each other. FIGS. 4A, 4B are more detailed partial cross-sectional views of the spinner subassemblies 110, 120 with the proximity sensors 200, 202 positioned to detect teeth passing through the sensing fields 208, 209, respectively. The actuator 70 can include a Linear Variable Differential Transformer (LVDT) sensor. The LVDT sensor can detect and report the position of the piston rod of the actuator 70 relative to the body of the actuator 70. This can provide real-time horizontal position measurements of the spinner subassemblies 110, 120 and can be used to determine the real-time horizontal position of the spinners 140 and determine the diameter D2 of the tubular 54. The LVDT sensor will be described in more detail below.

Referring again to FIGS. 3, 4A, 4B, regarding the spinner subassembly 110, the motor 114 can drive the drive gear 150. The drive gear 150 can be coupled to an intermediate gear 152 that transfers the rotational motion of the drive gear 150 (arrows 170) to the gears 154, 156 that rotate (arrows 174) the spinner drive shafts for the respective spinners 142, 144. The intermediate gear 152 can rotate (arrows 172) in an opposite direction than the gear 150 (arrows 170) and the gears 154, 156 (arrows 174).

Regarding the spinner subassembly 120, the motor 124 can drive the drive gear 160. The drive gear 160 is coupled to an intermediate gear 162 that transfers the rotational motion of the drive gear 160 (arrows 180) to the gears 164, 166 that rotate (arrows 184) the spinner drive shafts for the respective spinners 146, 148. The intermediate gear 162 can rotate (arrows 182) in an opposite direction than the gear 160 (arrows 180) and the gears 164, 166 (arrows 184).

The following discussion regarding FIGS. 3, 4A, 4B refers to the spinner subassembly 110 and an associated encoder, with proximity sensor 200, sensing field 208, encoder card 204, cable 134, gears 150, 152, 154, 156, and spinners 142, 144. Even though the following discussion refers to the spinner subassembly 110 and its associated encoder, it is equally applicable to the spinner subassembly 120 and its associated encoder, with proximity sensor 202, sensing field 209, encoder card 206, cable 136, gears 160, 162, 164, 166, and spinners 146, 148. It should be understood that the spinner assembly 40 includes the encoders for both spinner subassemblies 110, and 120. Therefore, the encoder cards 204, 206 are included in the spinner assembly, even if the encoder cards are disposed remotely from the spinner subassemblies 110, 120 (e.g. in a J-box that houses the controller 130 for the iron roughneck, or in any other location on the rig, such as locations of any of the processors of the rig controller 250, or separate from controller locations on the rig 10). Therefore, references to the encoder includes the associated proximity sensor and encoder card.

The proximity sensor 200 (e.g. an intrinsically safe inductive proximity sensor with an NPN sensing output or a PNP sensing output) can be positioned proximate to the drive gear 150 such that the proximity sensor 200 can detect when a tooth 62 of the gear 150 passes through a sensing field 208. When the tooth 62 is present in the sensing field 208, the proximity sensor 200 can switch to an output level (such as a higher voltage) that indicates the presence of the tooth 62.

When the tooth 62 is not present in the sensing field 208 (i.e. a valley 64 between teeth 62 of the gear 150 is in position of the sensing field 208), the proximity sensor 200 can switch to an output level (such as a lower voltage) that indicates that a tooth 62 is not present.

As the gear 150 rotates and causes alternating teeth 62 and valleys to pass through the sensing field 208 of the proximity sensor 200, the output of the proximity sensor 200 can become a pulse train with higher level outputs followed by lower level outputs. Therefore, a pulse train output from the proximity sensor 200 indicates that the gear 150 is rotating. Analysis of the pulse train can determine a speed of rotation of the gear 150. It should be understood that the presence of a tooth 62 in the sensing field 208 can also be represented by a lower level output with the absence of a tooth 62 (or the valley) present in the sensing field 208 being represented by a high level output. The proximity sensor 200 merely needs to cause its output to change from one level to the other level, so an encoder card 204 can interpret a proximity sensor output to count teeth as the teeth 62 of the gear 150 pass through the sensing field 208 of the proximity sensor 200. It should be understood that it is also envisioned that the waveform from the proximity sensor 200 can be analyzed to determine a duration of the tooth 62 being present or absent in the sensing field 208, in addition to a count of the number of teeth 62 that pass through the sensing field 208.

The encoder card 204 along with the proximity sensor 200 can provide the encoder function that monitors (e.g. counts) teeth 62 as a gear in the spinner subassembly 110 rotates. The encoder function can include an intrinsically safe inductive proximity sensor 200 and an encoder card 204. As can be seen, an encoder according to the principles of this disclosure, provides benefits for subterranean operations by directly detecting spinner wear in the spinner assembly 40 without positioning spark prone electronics in the spinner assembly 40. If the encoder function were implemented by a conventional encoder, not only would spark prone electronics be positioned in close proximity to the gears in the spinner subassembly 110, but the space required in the spinner subassembly 110 to accommodate the spark prone electronics would be undesirable due to the amount of space needed to isolate the spark prone electronics and maintain an Explosive (EX) Zone 1 certification of the iron roughneck 38.

Standards have been developed to guide the design of equipment to be used in these hazardous areas. Two standards (ATEX and IECEx) are generally synonymous with each other and provide guidelines (or directives) for equipment design. ATEX is an abbreviation for "Atmosphere Explosible". IECEx stands for the certification by the International Electrotechnical Commission for Explosive Atmospheres. Each standard identifies groupings of multiple EX zones to indicate various levels of hazardous conditions in a target area.

One grouping is for areas with hazardous gas, vapor, and/or mist concentrations.

- EX Zone 0—A place in which an explosive atmosphere consisting of a mixture with air of dangerous substances in the form of gas, vapor, or mist is present continuously or for long periods or frequently
- EX Zone 1—A place in which an explosive atmosphere consisting of a mixture with air of dangerous substances in the form of gas, vapor, or mist is likely to occur in normal operation occasionally.
- EX Zone 2—A place in which an explosive atmosphere consisting of a mixture with air of dangerous substances in the form of gas, vapor, or mist is not likely to occur in normal operation but, if it does occur, will persist for a short period only.

Another grouping is for areas with hazardous powder and/or dust concentrations.

- EX Zone 20—A place in which an explosive atmosphere in the form of a cloud of combustible dust in air is present continuously, or for long periods or frequently.
- EX Zone 21—A place in which an explosive atmosphere in the form of a cloud of combustible dust in air is likely to occur in normal operation occasionally.
- EX Zone 22—A place in which an explosive atmosphere in the form of a cloud of combustible dust in air is not likely to occur in normal operation but, if it does occur, will persist for a short period only.

The Zone normally associated with the oil and gas industry is the EX Zone 1. Therefore, the explosive atmosphere directives or guidelines for robotic systems used in subterranean operations are for an EX Zone 1 environment. Explosive atmosphere directives or guidelines for other EX Zones can be used also (e.g. EX Zone 21). However, the EX Zone 1 and possibly EX Zone 21 seem to be the most applicable for the oil and gas industry. ATEX is the name commonly given to two European Directives for controlling explosive atmospheres: 1) Directive 99/92/EC (also known as 'ATEX 137' or the 'ATEX Workplace Directive') on minimum requirements for improving the health and safety protection of workers potentially at risk from explosive atmospheres. 2) Directive 94/9/EC (also known as 'ATEX 95' or 'the ATEX Equipment Directive') on the approximation of the laws of Member States concerning equipment and protective systems intended for use in potentially explosive atmospheres.

Therefore, as used herein "ATEX certified" indicates that the article (such as an elevator or pipe handling robot) meets the requirements of the two stated directives ATEX 137 and ATEX 95 for EX Zone 1 environments. IECEx is a voluntary system which provides an internationally accepted means of proving compliance with IEC standards. IEC standards are used in many national approval schemes and as such, IECEx certification can be used to support national compliance, negating the need in most cases for additional testing. Therefore, as used herein, "IECEx certified" indicates that the article (such as an elevator or pipe handling robotic system) meets the requirements defined in the IEC standards for EX Zone 1 environments. As used herein, "EX Zone 1 certified" or "EX Zone 1 certification" refers to ATEX certification, IECEx certification, Canada and USA, or other countries for EX Zone 1 environments.

The novel arrangement of the encoder function of this disclosure minimizes space requirements in the spinner subassembly 110 and eliminates a need for additional structure to maintain an EX Zone 1 certification since the proximity sensor 200 can be intrinsically safe. Even if the wiring to the proximity sensor 200 is cut during operations, the wire will cause no spark.

The encoder card 204 can be disposed in a J-box on the iron roughneck 38 that houses the controller 130 with the J-box mounted remotely from the spinner subassembly 110. The J-box can be integral to the iron roughneck 38 and moveable with the iron roughneck 38. The J-box can be located in an EX Zone 2 certified area. The encoder card 204 can be coupled to the proximity sensor 200 via the cable 134 which transmits an output of the proximity sensor 200 to the encoder card 204. The encoder card 204 can process the sensor data from the proximity sensor 200 to determine the number of teeth of a gear that passed by the sensing field 208 of the proximity sensor 200 and send the results to the controller 130. The encoder card 204 can also produce a pulse train from the sensor data, the pulse train being representative of the number of teeth 62 passing the proximity sensor 200 and a speed of the teeth 62 as they pass the proximity sensor 200.

It should be understood that each of the gears 150, 152, 154, 156 in the spinner subassembly 110 can have a different number of teeth in keeping with the principles of this disclosure. However, in this example, the gears 150, 152, 154, 156 of the spinner subassembly 110 each have 16 teeth. Therefore, if the drive gear 150 rotates (arrows 170) a single revolution (i.e. 360 degrees), then each of the other gears 152, 154, 156 will also rotate (arrows 172, 174) a single revolution, and thus the spinners 142, 144 will rotate (arrows 174) a single revolution. If the drive gear is rotated multiple revolutions, or even a fraction of a revolution, or combinations thereof, the spinners 142, 144 will be rotated the same amount. When the spinners 142, 144 are used to rotate (arrows 91) a tubular 54, the number of revolutions of the tubular 54 can be calculated from knowing the number of revolutions of the spinners 142, 144, an outer diameter D1 of the spinners 142, 144, and an outer diameter D2 of the tubular 54. When the number of revolutions of the spinners 142, 144 is $R_{142}$ and the number of revolutions of the tubular 54 is represented by $R_{54}$, then the Equation (1) below can be used to determine $R_{54}$, from the diameters D1, D2, and $R_{142}$:

$$R_{54}=D1/D2*R_{142} \quad (1)$$

When the spinners 142, 144 rotate (arrows 174), the amount of rotation imparted to the tubular 54 (assuming no slippage) is a ratio of the circumference 190 of the spinners 142, 144 to the circumference 192 of the tubular 54. For example, if the circumference 192 is twice as long as the circumference 190, then if the spinners 142, 144 rotate two revolutions, the tubular 54 would rotate one revolution. The circumference 192 of the tubular 54 equals [π*D2] and the circumference 190 of the spinners 142, 144 equals [π*D1]. The ratio RT1 of the circumference 190 to the circumference 192 equals [π*D1/π*D2] which equals [D1/D2]. If the revolutions of the spinners 142, 144 are known, then the revolutions of the tubular 54 can be calculated by the equation (1) above which can otherwise be stated as Equation (2) below:

$$R_{54}=RT1*R_{142} \quad (2)$$

Conversely, if it is desirable to rotate the tubular 54 a known number of revolutions $R_{54}$, then the number of revolutions $R_{142}$ of the spinners 142, 144 that are required to produce the desired tubular revolutions $R_{54}$ is given as:

$$R_{142}=D2/D1*R_{54} \quad (3)$$

or $$R_{142}=RT2*R_{54} \quad (4)$$

where RT2 is the ratio of the outer diameter D2 to the outer diameter D1.

The spinner subassemblies 110, 120 can be moved toward or away from each other in the directions indicated by arrows 66, 68. When the subassemblies are moved toward each other the spinners 142, 144, 146, 148 can engage the tubular 54 and induce rotation of the tubular 54 by rotating the drive gears 150, 160, which rotates the spinners 142, 144, 146, 148, respectively.

As stated above, it is not a requirement that the gears in the spinner subassemblies 110, 120 have the same number of teeth thereby producing a 1:1 gear ratio. The gears in the spinner subassemblies 110, 120 can be configured to produce various gear ratios other than 1:1. Sometimes it is desirable to increase or decrease the torque applied by the spinner subassemblies 110, 120 to the tubular 54, or increase or decrease the rotational speed imparted to the tubular 54 by the spinner subassemblies 110, 120. Generally, the torque applied to the tubular 54 by the spinner subassemblies 110, 120 is inversely proportional to the rotational speed imparted to the tubular 54. Therefore, changing the configuration of the gears (e.g. gears 150, 152, 154, 156 in spinner assembly 110) can increase torque while reducing a rotational speed or decrease torque while increasing a rotational speed. The speed can also be independently adjusted by increasing or decreasing a speed of the motor (e.g. 114) which drives the drive gear (e.g. 150). Changing the speed of the motor driving the drive gear is fairly straight forward but changing the gear ratio of the gears in one or both of the spinner subassemblies 110, 120 is not as straight forward.

According to certain embodiments, the spinner subassemblies 110, 120 of the current disclosure can be modified in the field (e.g. on the rig floor or other locations, such as at the factory) to provide increased or decreased torque to the tubular 54. To adjust the gear ratio of the gears in a spinner subassembly 110, 120, the cover of the spinner subassembly 110, 120 can be removed to reveal the gears inside (e.g. 150, 152, 154, 156). This description will focus on the spinner subassembly 110, but it is equally applicable to the spinner subassembly 120.

With the cover of the spinner subassembly 110 removed (as shown in FIG. 3), the gears 150, 152, 154, 156 can be removed and replaced with gears of various sizes to increase or decrease the torque applied to the tubular 54 when compared to the torque applied to the drive gear 150 via the motor 114. Therefore, the torque applied to the drive gear 150 can be multiplied by the resulting gear ratio of the gears 150, 152, 154, 156 and applied to the tubular 54 when the spinner assembly 40 is engaged with the tubular 54.

To remove and replace the gears 150, 152, 154, 156, each gear has a shaft (e.g. drive shaft, idler shaft, etc.) with a keyway that interfaces with a key on the respective gear. The gears 150, 152, 154, 156 can be removed from their respective shafts and replaced with a gear that is a different size. With different sizes, the shafts for the gears 150, 154, 156 remain in their original positions, but the shaft for the gear 152 can be repositioned to accommodate the changing sizes of the gears 150, 154, 156. By changing these gears 150, 152, 154, 156 for the sizes that produce the desired gear ratio, the torque applied to the tubular 54 relative to the torque applied by the drive gear 150 can be changed. This ability to reconfigure the spinner assembly 40 with minimal disassembly allows certain embodiments of the spinner assembly 40 of this disclosure to be used in a wider range of applications.

By changing the gear ratios, the spinner assembly 40 can also produce various rotational speeds for spinning the tubular 54. When lower torque is sufficient to perform the spinner functions, then the gears can be configured to increase the rotational speed of the tubular 54 to reduce threading and unthreading times.

Figure 5B:
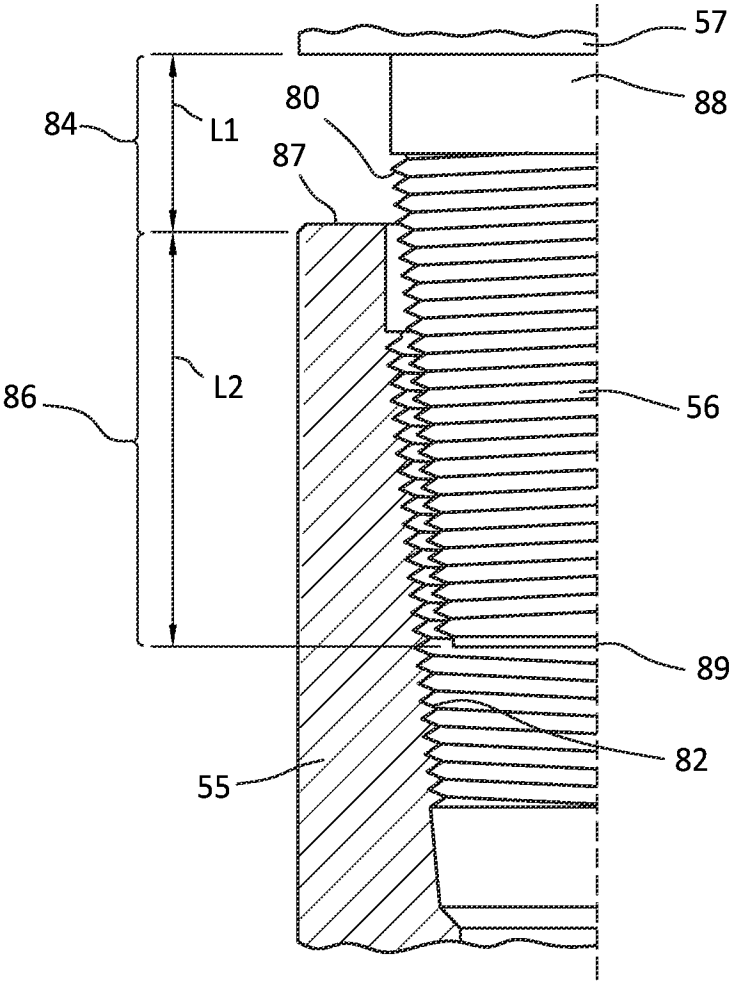
FIG. 5B is a representative detailed partial cross-sectional view of an area 5B in FIG. 5A, in accordance with certain embodiments.
Figure 5A:
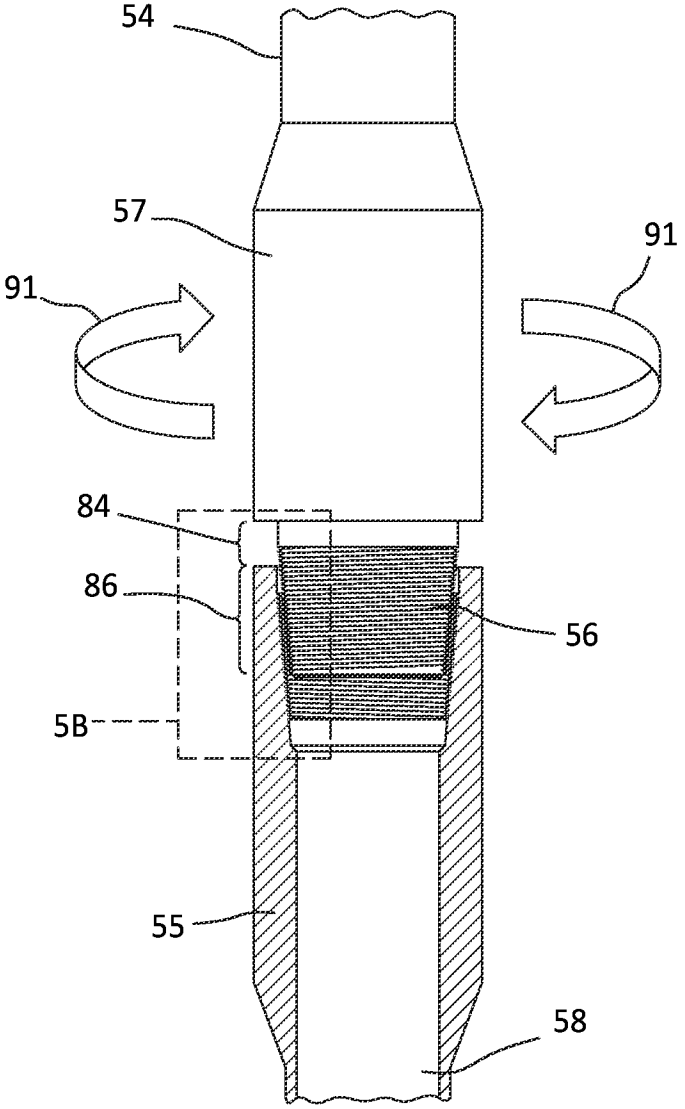
FIG. 5A is a representative partial cross-sectional view of a joint in a tubular string prior to a connection being made, in accordance with certain embodiments.

Referring to FIGS. 5A and 5B, when a tubular string 58 is being tripped into the wellbore 15, a pipe handler 30, top drive 18, etc. can lower a tubular 54 to a stump of the tubular string 58 that extends above the rig floor 16. To make a connection between the tubular 54 and the tubular string 58, a pin end 57 of the tubular 54 can be inserted into the box end 55 of the tubular string 58. A portion 86 of the threaded end 56 can be inserted into the box end 55 by a distance L2 before the exterior threads 80 on the threaded end 56 engage the interior threads 82 in the box end 55. This forms a gap 84, of distance L1, between the shoulder 88 of the pin end 57 and the top end 87 of the box end 55. Once the engagement is achieved, the tubular 54 can then be rotated (e.g. via the spinner assembly 40) relative to the box end 55 to thread the joint together. When the shoulder 88 of the pin end 57 engages the top end 87 of the box end 55, the pin end 57 has been spun into the box end 55. At this point, the wrench assembly 42 can torque the joint to complete the connection.

The current disclosure describes using manufacturing specifications of tubulars to determine (e.g. estimate) the length L1 of the gap 84 for various tubular sizes, dimensions, and types. With the length L1 known (e.g. estimated, calculated, determined, etc.), then the number of revolutions needed to spin the pin end of the tubular 54 into the box end of the tubular string 58 can be determined by multiplying the length L1 times the threads per unit length (e.g. inch, mm, cm, m, etc.) of the threaded portion 56 of the pin end 57.

Figure 6A:
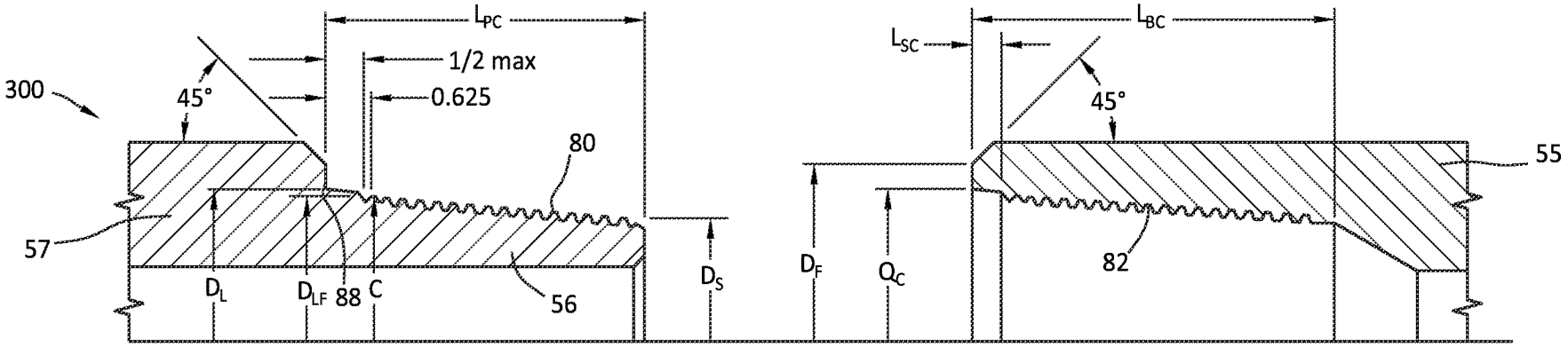

FIG. 6A shows a representative specification drawing 300 that defines the terms in the datasheet table 302 in FIG. 6B. By setting the slope of the box end 55 and the pin end 57 equal to each other, and solving for the interface point yields the equation (5) below:

$$L2=0.625+(Q_C-D_S)/(2*(C-D_S)/(L_{PC}-0.625)) \quad (5)$$

where:

L2 is the setdown depth that is the distance the threaded end 56 can be inserted into the box end 55 before the exterior threads 80 on the threaded end 56 engage the interior threads 82 in the box end 55, 0.625 is a distance in inches from the shoulder 88 to the top of the teeth 80 on the pin end 57, $Q_C$ is the box end 55 counter bore diameter, $D_S$ is the pin end 57 minor bore diameter, C is the pin end 57 pitch diameter at a Gage Point, and $L_{PC}$ is the length of the threaded portion 56 of the pin end 57.

With the distance L2 calculated from the manufacturer's specifications a minimum setdown offset, MSO can be calculated by subtracting an allowance factor AF1 of 10 mm (0.394 inches) from L2.

$$\text{MSO}=L2-\text{AF1} \quad (6)$$

where:

MSO is a minimum setdown offset which is a minimum distance the pin end 57 can be inserted into the box end 55, L2 is a calculated distance using Equation 5 above that is the distance the threaded end 56 can be inserted into the box end 55 before the exterior threads 80 on the threaded end 56 engage the interior threads 82 in the box end 55, and AF1 is an allowance factor (e.g.) to ensure full insertion of pin end 57. The allowance factor AF1 can be adjusted as needed. The current examples use AF1 of 10 mm (0.394 inches), but it is not required that the allowance factor AF1 be 10 mm (0.394 inches).

With the minimum setdown offset MSO determined, the distance L1 of the threaded portion 84 (or gap 84) can be determined. As seen in FIG. 5B, $L_{PC}$ is equal to L1+L2. Therefore, solving for L1 yields the equation (7) below:

$$L1=L_{PC}-L2 \quad (7)$$

where:

L1 is the calculated distance of the gap 84 between the top end 87 of the box end 55 and the shoulder 88 of the pin end 57, $L_{PC}$ is the length of the threaded portion 56 of the pin end 57, and L2 is a calculated distance using Equation 5 above that is the distance the threaded end 56 can be inserted into the box end 55 before the exterior threads 80 on the threaded end 56 engage the interior threads 82 in the box end 55.

With the distance L1 determined, then the number of revolutions $R_{54}$ of the pin end 57 that would be necessary to fully thread the pin end 57 into the box end 55 can be determined. The manufacturer's specifications can be converted from English dimensions to metric dimensions, but the current specifications included in FIGS. 6B and 7 are a mixture of both. The manufacturer's specifications in FIG. 6B includes the number of threads per inch TH. Therefore, the Equation (8) below can be used to calculate the number of revolutions $R_{54}$ of the pin end 57 that are needed to fully thread the pin end 57 into the box end 55 after the spinners 140 spin the tubular 54 the desired number of revolutions $R_{54}$.

$$R_{54}=(L1*TH) \quad (8)$$

where:

$R_{54}$ is the number of revolutions of the pin end 57 of the tubular 54 that would be necessary to fully thread the pin end 57 into the box end 55, L1 is the calculated distance of the gap 84 between the top end 87 of the box end 55 and the shoulder 88 of the pin end 57, and TH is the threads per inch supplied by the manufacturer or determined by any other means such as measuring.

An additional allowance factor AF2 can be added to the number of revolutions $R_{54}$ to produce a maximum number of revolutions $R_{MAX}$. The maximum number of revolutions $R_{MAX}$ can be used to determine if the spinners 140 have worn past an acceptable level of wear. Therefore, the allowance factor AF2 can be adjusted as needed to allow more or less wear of the spinners 140 before replacement is initiated. For example, if AF2 is equal to 0.5 revolutions, then $R_{MAX}$ would be $R_{54}$+0.5 revolutions (see Equation (9) below). This would allow an extra half-turn of the tubular 54 after spinning the tubular 54 the number of revolutions $R_{54}$.

$$R_{MAX}=R_{54+}\text{AF2} \quad (9)$$

where:

$R_{MAX}$ is a maximum number of revolutions of the tubular 54 by the spinners 140, $R_{54}$ is the number of revolutions calculated for the tubular 54, and AF2 is an allowance factor to ensure tubular 54 is completely threaded into the tubular string.

The number of revolutions $R_{54}$ is calculated to completely thread the pin end 57 into the box end 55. However, adding the allowance factor AF2 can help ensure that the pin end 57 is completely threaded into the box end 55. If it takes more revolutions than the maximum number of revolutions $R_{MAX}$ to spin the pin end 57 of the tubular 54 into the box end 55 of the tubular string 58, then this can possibly indicate the spinners 140 of the spinner assembly 40 are worn past an acceptable level of wear and the wear status of the spinners indicates replacement is needed. If it takes less revolutions than the maximum number of revolutions $R_{MAX}$ to spin the pin end 57 of the tubular 54 into the box end 55 of the tubular string 58, then this can possibly indicate the spinners 140 of the spinner assembly 40 are not worn past an acceptable level of wear and the wear status of the spinners indicates spinners still operating acceptably.

Now that it has been shown how to calculate the maximum number of revolutions $R_{MAX}$, it can be shown how to correlate the maximum number of revolutions $R_{MAX}$ to the expected number of spinner revolutions $R_{142}$ and finally to the expected number of revolutions of the drive gear $R_{150}$ needed to produce the maximum number of revolutions $R_{MAX}$ in the tubular 54.

As stated above in Equation (4), $R_{142}=RT2*R_{54}$, with RT2 being a ratio of the outer diameter D2 of the tubular 54 to the outer diameter D1 of the spinner (i.e. D2/D1). Equation (10) below can be used to calculate the revolutions of the drive gear 150 required to rotate the spinner by the number of revolutions $R_{142}$ $$R_{150}=RT3*R_{142} \tag{10}$$

where RT3 is a gear ratio between the drive gear 150 and the spinner gear 154.

In the embodiments of the spinner subassembly 110 in FIGS. 4A and 4B, it can be seen that all gears 150, 152, 154, 156 are the same size and have 16 teeth each. Therefore, a gear ratio RT3 between the drive gear 150 and the spinner gear 154 is "1:1" meaning that the spinner gear 154 will rotate the same number of revolutions as does the drive gear 150. The spinner 142 will also rotate the same number of revolutions as does the spinner gear 154 since the spinner gear 154 is coupled directly to a drive shaft of the spinner 142. Therefore, if the number of revolutions $R_{142}$ of the spinner 142 is given, then the number of revolutions $R_{150}$ of the drive gear 150 is known and equal to the number of revolutions $R_{142}$, and the number of revolutions $R_{154}$ of the spinner gear 154 is known and equal to the number of revolutions $R_{142}$.

Figure 8:
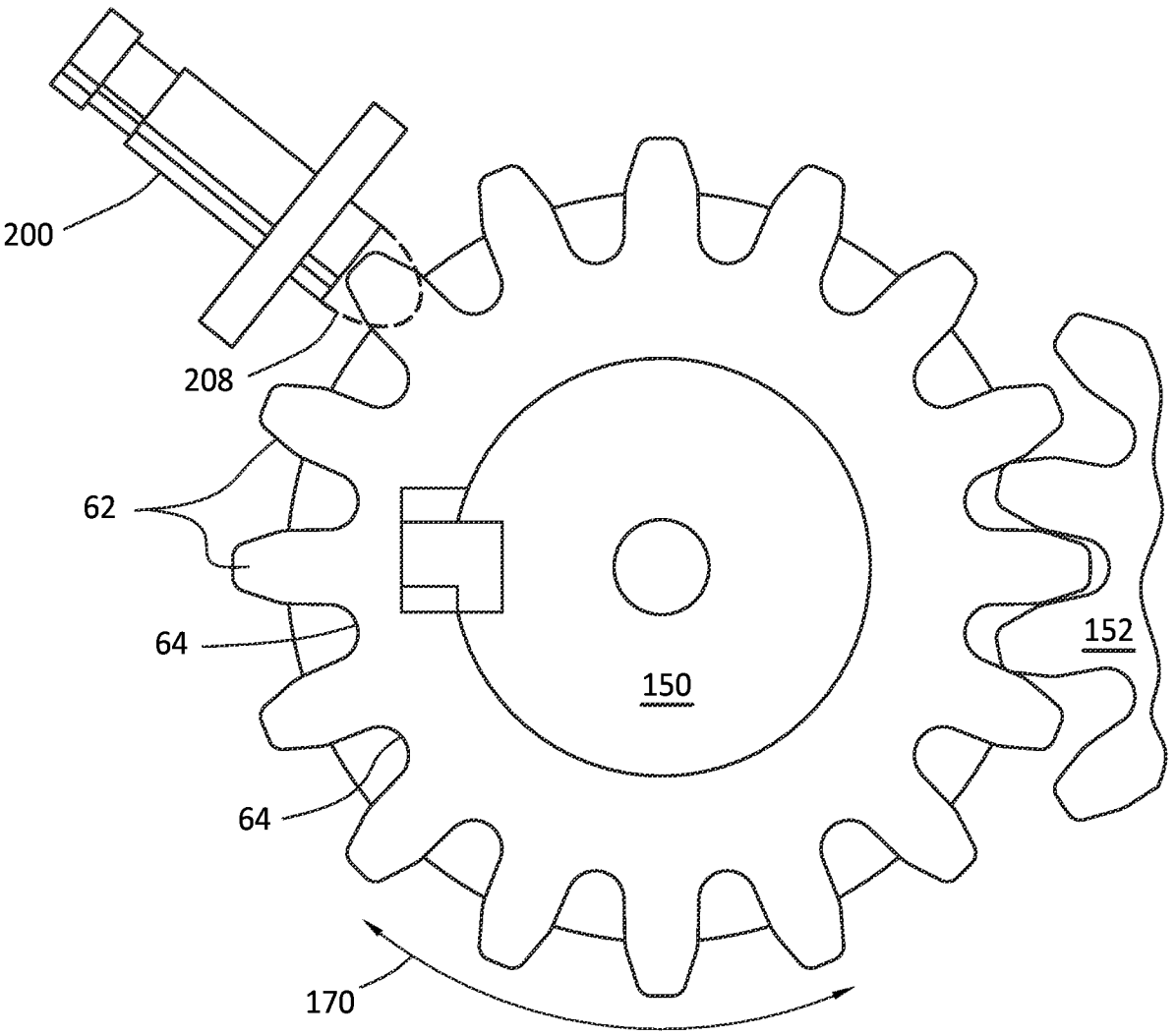
FIG. 8 is a representative top view of gear with a proximity sensor arranged to count gear teeth, in accordance with certain embodiments.

Referring to FIG. 8, the proximity sensor 200 is shown disposed proximate a tooth 62 of the drive gear 150. It has been shown how to calculate the maximum number of revolutions $R_{MAX}$ from the manufacturing specifications and allowance factors AF1, AF2. However, to make use of the encoder that includes the proximity sensor 200 and the encoder card 204, the maximum number of revolutions $R_{MAX}$ needs to be correlated to the number of teeth 62 that have to pass by a sensing field 208 of the proximity sensor 200 to produce the maximum number of revolutions $R_{MAX}$ in the tubular 54.

In this example, the drive gear 150 has sixteen teeth 62, so each revolution of the drive gear 150 will cause sixteen teeth 62 to pass through the sensing field 208 of the proximity sensor 200, which will produce a pulse train of sixteen pulses for each revolution. Continued revolutions of the drive gear will produce additional pulses in the pulse train. The encoder card 204 can count each pulse in the pulse train to determine the total number of teeth $N_{62}$ that pass through the sensing field 208 from when a spinning operation of the spinner assembly begins and ends. It should be understood that the controller 130 (or controller 250) can command the spinner assembly 40 to engage the tubular 54 with the spinners 140.

When the spinners 140 begin to spin the tubular 54 to make a connection to the tubular string 58, then the encoder 204 will begin counting teeth 62 to produce the number of teeth $N_{62}$. The controller 130 (or controller 250) can detect that the connection is made when the teeth counting stops, which indicates that the shoulder 88 of the pin end has engaged with the top end 87 of the box end 55. The controller 130 (or controller 250) can then command the spinner assembly 40 to stop rotation of the tubular 54 and disengage from the tubular 54.

The final value of the number of teeth $N_{62}$ after stopping rotation of the tubular 54 can be the value that is indicative of the total number of revolutions of the tubular 54 (i.e. $N_{62}/16$=total number of actual revolutions $AR_{150}$ of the drive gear 150). The expected number of revolutions $R_{150}$ can be compared to the actual number of revolutions $AR_{150}$ to determine if the drive gear rotated more or less revolutions than expected. If it is rotated more than expected, then the spinners 140 may have an unacceptable amount of wear. If it is rotated less than expected, then the spinners 140 may have an acceptable amount of wear. If it is rotated much less than expected, then this can indicate a cross threading of the joint connection has occurred.

Referring back to FIGS. 6B and 7, an expected number of teeth $N_{62}$ will be determined for an example tubular 54 characterized by manufacturer's data and calculated data from lines 304 of the tables 302, 306. The setdown depth L2 is calculated to be 3.53 inches (89.65 mm) using Equation (5). The minimum setdown offset MSO is calculated to be 3.14 inches (79.65 mm) when assuming an allowance factor AF1 of 10 mm (o.395 inches) and using Equation (6). The distance L1 of the gap 84 is calculated to be 1.36 inches (34.65 mm) using Equation (7) and substituting the minimum setdown offset MSO for the setdown depth L2. The desired number of revolutions $R_{54}$ is calculated to be 2.73 revolutions using Equation (8). The maximum number of revolutions $R_{MAX}$ is calculated to be 3.23 revolutions when assuming an allowance factor AF2 of 0.5 revolutions and using Equation (9). The number of revolutions of the drive gear 150 $R_{150}$ is calculated to equal to the number of revolutions of the spinner $R_{142}$ based on Equation (10) and the ratio RT3 being "1:1".

Assuming the diameter D1 of the spinner 142 is 5.125 inches, and with the diameter D2 of the tubular 54 being 5 inches (see table 302), then the ratio RT2 would be 5 inches/5.125 inches (per Equation (3)) that equals 0.976. Using the calculated value of $R_{MAX}$ (i.e. 3.23 revolutions) for $R_{54}$ in Equation (4), with the ratio RT2 being 0.976, then the number of revolutions of the spinner $R_{142}$ (as well as $R_{150}$) is 3.15 revolutions for this example. With sixteen teeth for each revolution of the drive gear 150, the total number of teeth that should pass by the pair of proximity sensors 200 is 50 (i.e. 50.4 rounded down). The controller 130 (or controller 250) can use this value (i.e. 50) to compare to the actual number of teeth 62 $AN_{62}$ that pass the pair of proximity sensors 200 when the tubular 54 is actually spun into a connection with the tubular string 58. If more teeth 62 are counted, then the spinners may be worn past an acceptable level. If the actual number of teeth $AN_{62}$ counted is from 50 to 30, then the spinners may not be worn past an acceptable level. If fewer teeth than 30 are counted then a cross threading of the joint connection may have occurred.

Figure 9:
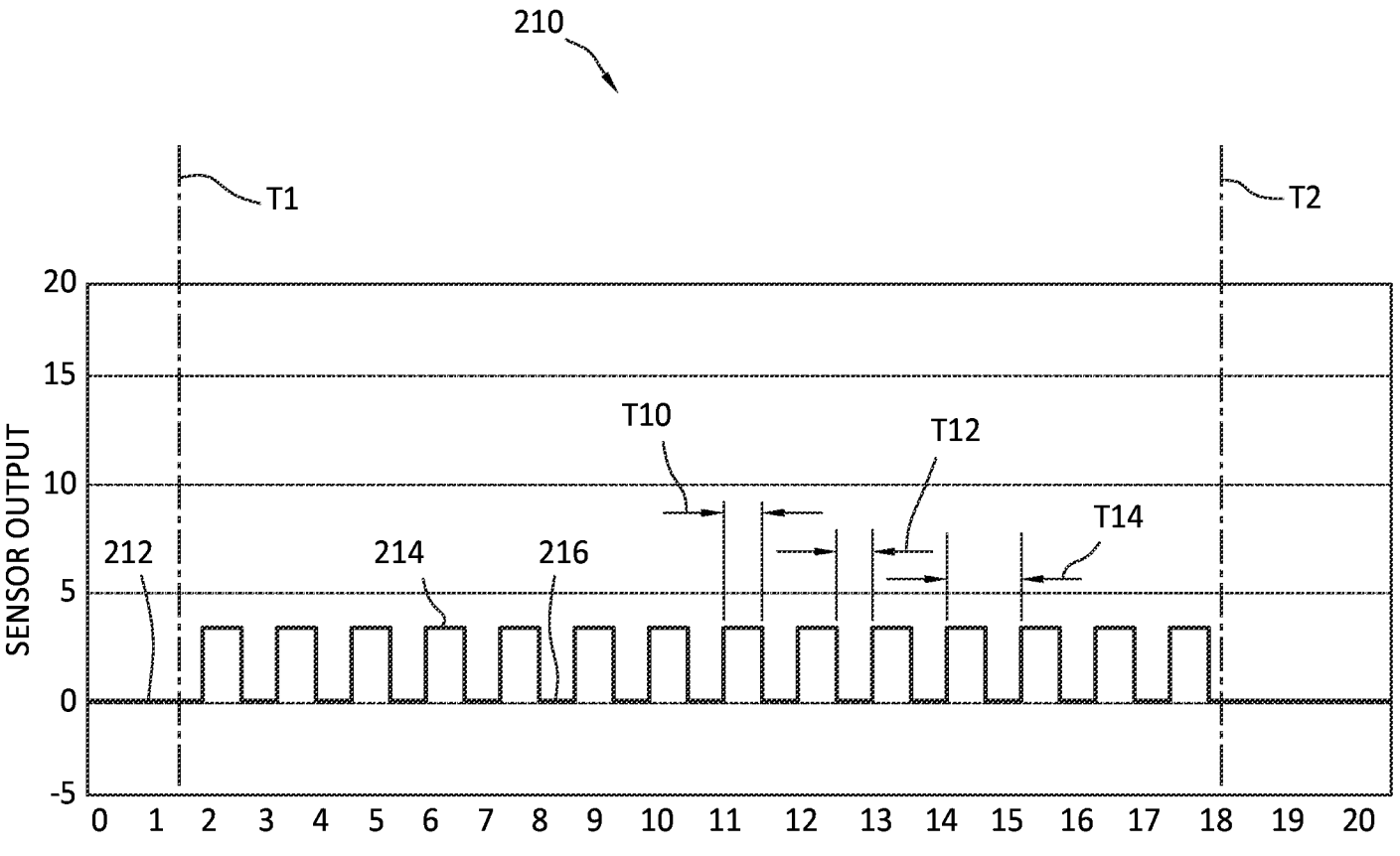
FIGS. 9-12 are representative plots of outputs from proximity sensors that are arranged as in FIG. 8, in accordance with certain embodiments.

FIG. 9 is representative of a pulse train that can be produced by the proximity sensors 200, 202 and sent to their respective encoder cards 204, 206. It should be understood that line 212 is only representative of a pulse train that can be produced by the proximity sensors 200, 202 and that more of fewer pulses 214 and valleys 216 can be included in the line 212. The pulses 214 are given an arbitrary intensity which is merely shown to represent that the pulses are at a higher level of output from the proximity sensors 200, 202 than the valleys 216 and this difference between the pulses 214 and the valleys 216 can be recognized by the encoder cards 204, 206, respectively, to count teeth that pass the sensing field 208, 209. It should be understood that other proximity sensors 200, 202 can be used that would basically invert the pulses 214 and valleys 216 such that a lower output level from the sensors would indicate that a tooth 62 is present and a higher level output level from the sensors would indicate a tooth 62 is not present.

The spinners 140 can begin to rotate at time T1 and stop rotating at time T2. This can be representative of a spin-in operation using the spinners 140. Time period T10 represents a duration of the pulse 214 and time period T12 represents a duration of the valley 216. The time period T14 represents a cycle time from one tooth 62 to the next tooth 62. Up to the time T1, when the spinners 140 begin to rotate, the proximity sensor 200, 202 show to be positioned adjacent a valley 64 of the drive gear 150, 160.

Figure 10:
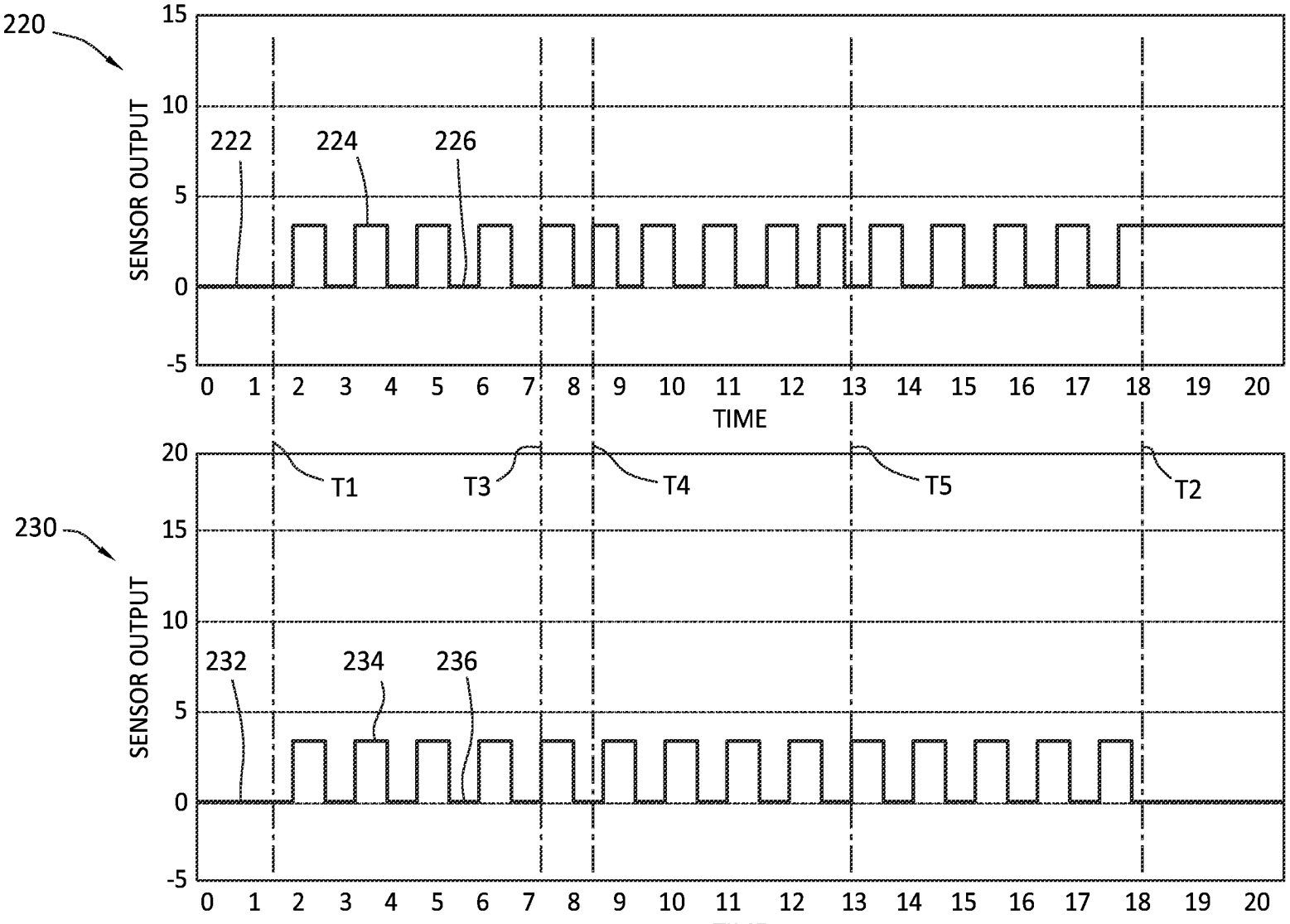

FIG. 10 shows representative plots 220, 230 of the sensor data output from proximity sensors 200, 202, respectively. The plot 220 includes line 222 that can represent sensor data as a function of time for the proximity sensor 200 of the spinner subassembly 110. The plot 230 includes line 232 that can represent sensor data as a function of time for the proximity sensor 202 of the spinner subassembly 120. In this example, both drive gears 150, 160 begin rotating at time T1, with each of the proximity sensors 200, 202 positioned proximate a valley 64 on the drive gear 150, 160, respectively.

The sensor data indicates that the drive gears 150, 160 are in sync through time T3, but become slightly out of sync by time T4. Notice the valley 226 and pulse 224 proximate time T4 are narrowed when compared to the valley 236 and the pulse 234 of line 232. Line 222 indicates by time T4 that a tooth 62 has passed through the sensing field 208 of the proximity sensor 200 earlier than the tooth 62 passed through the sensing field 209 proximity sensor 202. This can indicate that the spinners 142, 144 of the spinner subassembly 110 may have slipped on the tubular 54 that would have, at least temporarily, accelerated the drive gear 150. From time T4 to T5, the drive gears 150, 160 seem to be rotating at the same speed until close to time T5, where the drive gear 150 again temporarily accelerates relative to the drive gear 160. At time T2, when the spinner assembly 40 is stopped and disengaged from the tubular 54, the drive gears 150, 160 remain out of sync with each other.

It should be understood that it is not a requirement that the drive gears 150, and 160 be in sync at any point in time. It can start at time T2 out of sync and end at time T3 out of sync. However, with them in sync at the beginning of this example, it is easier to understand the variations between the two lines 222, 232, and thus the two drive gears 150, 160, respectively.

FIG. 10 indicates that a wear status for the spinners 140 can be determined by comparing the performance of the spinners 140 (i.e. 142, 144) in the spinner subassembly 110 to the performance of the spinners 140 (i.e. 146, 148) in the spinner subassembly 120. If the tooth count $N_{62}$ from the encoder card 204 is greater than the tooth count $N_{62}$ from the encoder 206 by a pre-determined number, or the tooth count $N_{62}$ from the encoder card 204 is less than the tooth count $N_{62}$ from the encoder 206 by a pre-determined number, the controller 130 (or rig controller 250) can determine which of the encoder cards 204, 206 provided a tooth count $N_{62}$ that is outside of a value range, then the controller 130 (or rig controller 250) can initiate remove and replace operations to replace the spinners in the failing spinner subassembly 110, 120.

Figure 11:
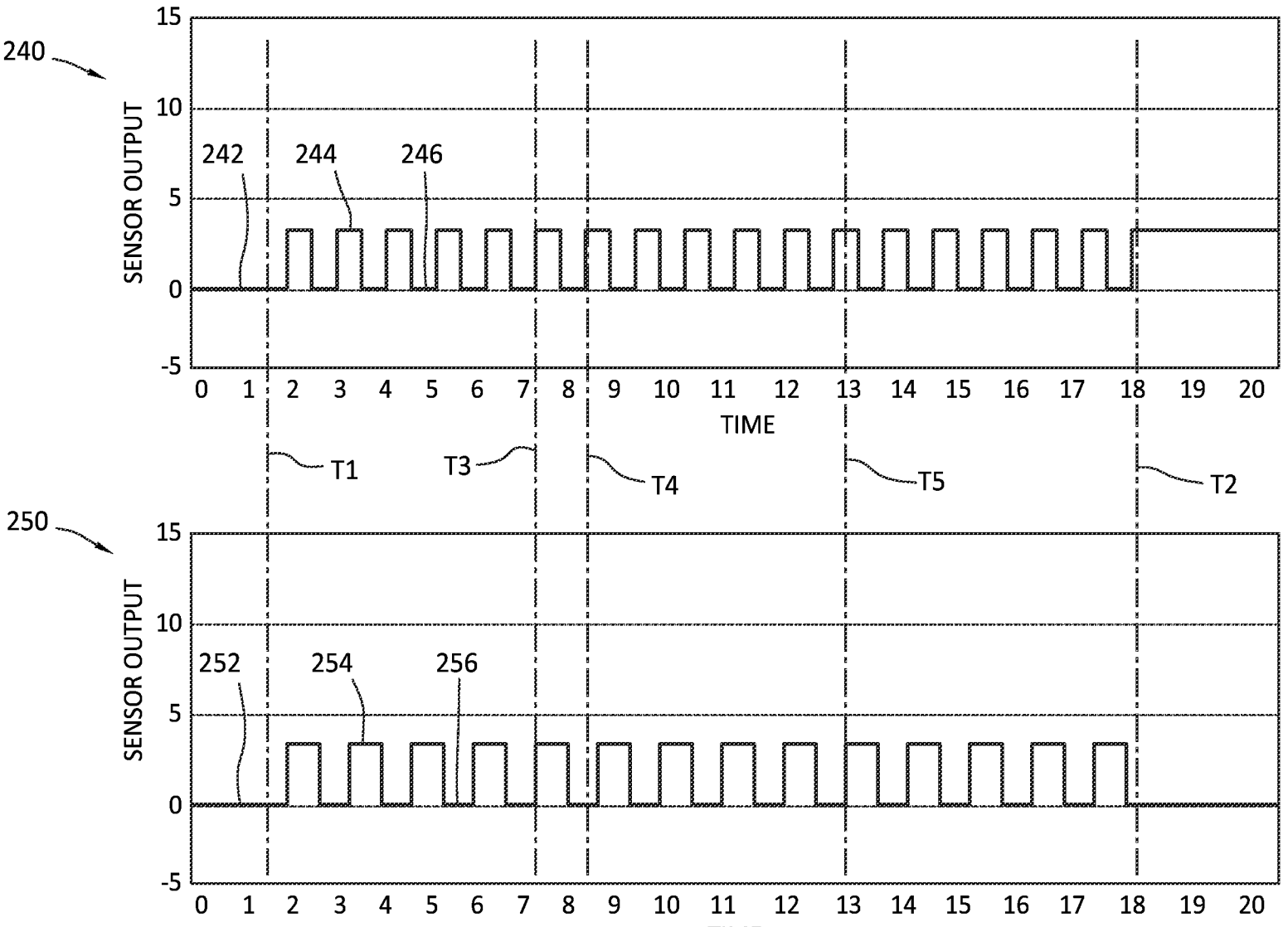

FIG. 11 are representative plots 240, 250 of the sensor data output from proximity sensors 200, 202, respectively. The plot 240 includes line 242 that can represent sensor data as a function of time for the proximity sensor 200 of the spinner subassembly 110. The plot 250 includes line 252 that can represent sensor data as a function of time for the proximity sensor 202 of the spinner subassembly 120. In this example, both drive gears 150, 160 begin rotating at time T1, with each of the proximity sensors 200, 202 positioned proximate a valley 64 on the drive gear 150, 160, respectively.

The lines 242, 252 indicate that the drive gear 150 (and thus the spinners 142, 144) of the spinner subassembly 110 are rotating faster than the drive gear 160 (and thus the spinners 146, 148) of the spinner subassembly 120. This appears to indicate that the spinners 142, 144 are continuing to slip on the tubular 54 during the spin-in operation. The speed the teeth 64 are moving through the sensing fields 208, 209 can also be used to calculate the speed the drive gear 150, 160 is rotating and thus the speed that the spinners 142, 144, 146, 148, respectively, are rotating. As can be seen, the cycle time T14 of the line 242 between times T3 and T4 is shorter than the cycle time T14 of the line 252 in that same time period.

Figure 12:
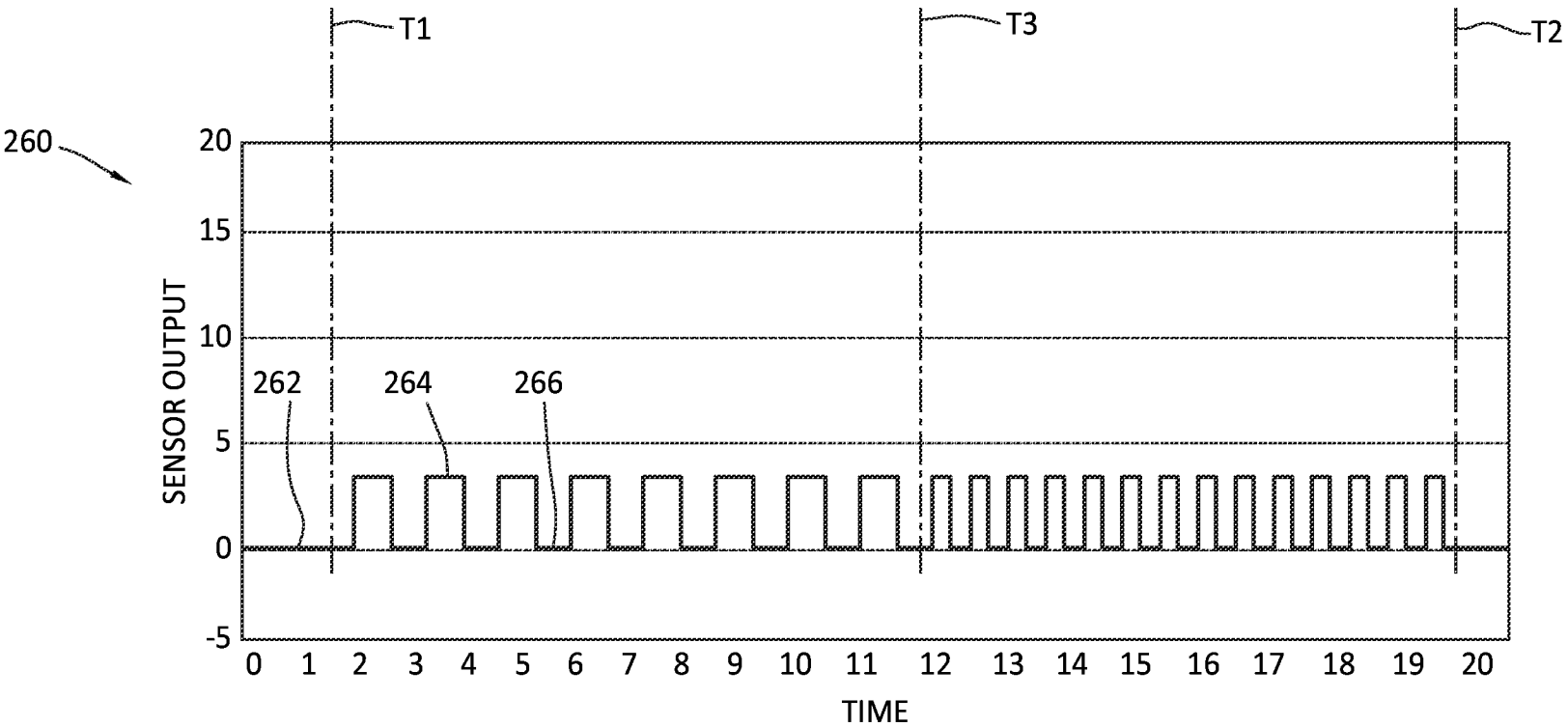

Referring to FIG. 12, the encoder function can be used to determine if a tubular 54 has been completely spun-out of the box end 55 of a tubular string 58. During tripping a tubular string 58 out of the wellbore 15, the top tubular 54 in the tubular string 58 is broken loose by a torque wrench 42, and then the spinner assembly 40 can spin the tubular 54 the rest of the way out of the box end 55 of the tubular string 58. The encoder function along with the controller 130 or controller 250 can be used to determine a speed of rotation of the drive gears 150, 160 of the spinner subassemblies, 110, 120, respectively.

The plot 260 includes a line 262 that can represent a pulse train from either of the proximity sensors 200, 202. At time T1, the spinner assembly 40 begins rotating the spinners 140 to unthread the tubular 54 from the box end 55 of the tubular string 58. The pulses 264 and valleys 266 indicate a steady speed of rotation of the drive gear 150, 160, when at time T3 the speed of rotation of the drive gear 150, 160 is increased as seen by a shortened cycle time T14 between times T3 and T2. The increased speed of rotation between times T3 and T2 can indicate that the rotational speed of the tubular 54 has increased due to reduced friction of the threads, and the tubular 54 is completely unthreaded from the box end 55 of the tubular string 58.

Figure 13:
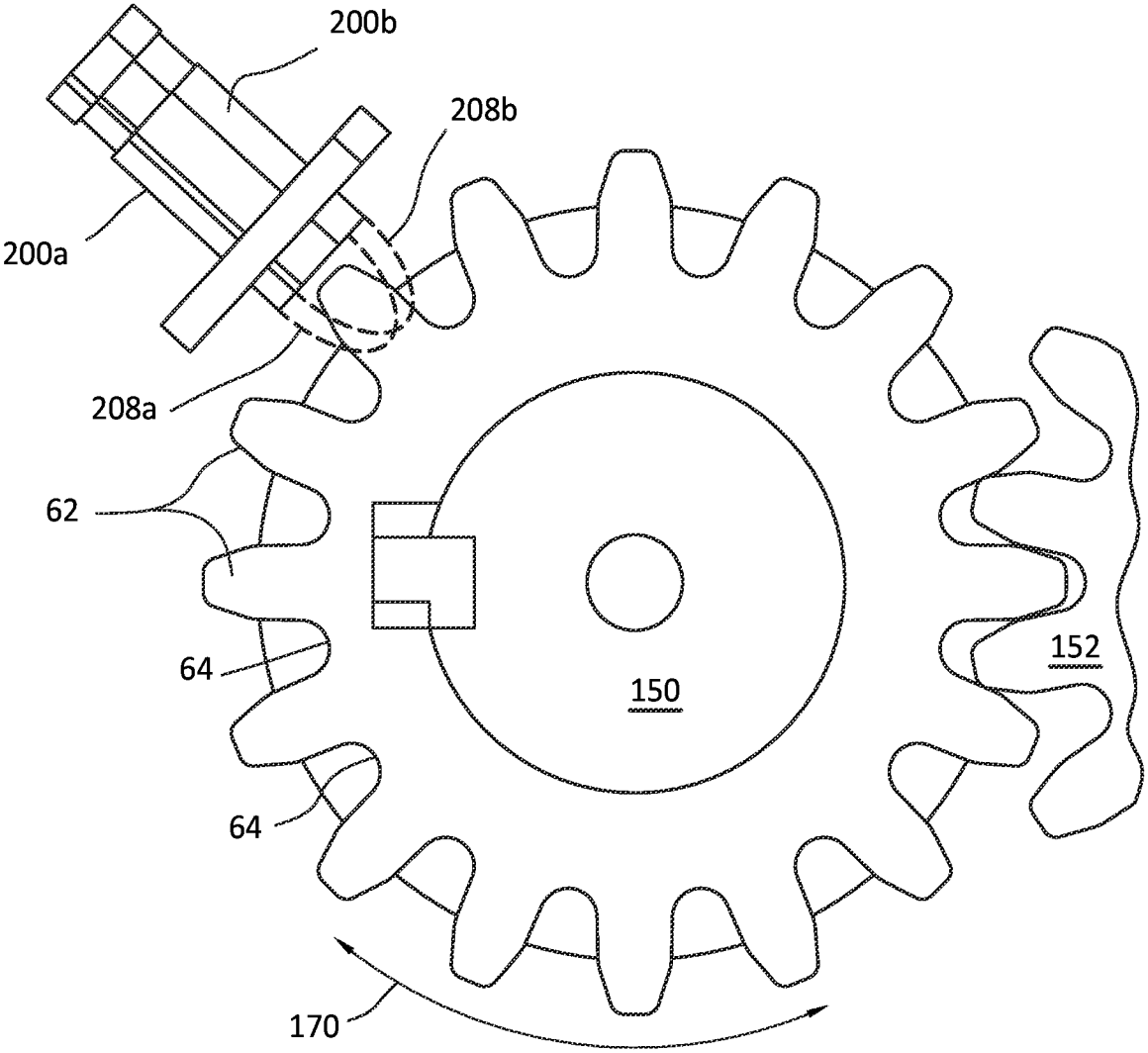
FIG. 13 is a representative top view of gear with a proximity sensor arranged to count gear teeth, in accordance with certain embodiments.

Referring to FIG. 13, this configuration is very similar to the configuration shown in FIG. 8. However, this configuration differs from FIG. 8 in that the proximity sensor 200 of FIG. 8 is replaced by a pair of proximity sensors 200*a*, 200*b*. The proximity sensor 200*a* has an associated sensing field 208*a*, and the proximity sensor 200*b* has an associated sensing field 208*b*. Each proximity sensor 200*a*, 200*b* can be coupled to a separate input of the encoder card 204, where the encoder card 204 can receive a pulse train from each of the proximity sensors 200*a*, 200*b* that represent the presence of a tooth 62 as each tooth 62 passes through the respective sensing fields 208*a*, 208*b*. It should be understood that the previous description regarding the proximity sensor 200 is applicable to each of the proximity sensors 200*a*, 200*b*, where each can detect the teeth 62 of the drive gear 150 and provide a pulse train to the encoder card 204.

Similarly, the proximity sensor 202 of FIGS. 3, 4A, 4B can be replaced by a pair of proximity sensors 202*a*, 202*b*. The proximity sensor 202*a* has an associated sensing field 209*a*, and the proximity sensor 202*b* has an associated sensing field 209*b*. Each proximity sensor 202*a*, 202*b* can be coupled to a separate input of the encoder card 206, where the encoder card 206 can receive a pulse train from each of the proximity sensors 202*a*, 202*b* that represent a presence of a tooth 62 as each tooth 62 passes through the respective sensing fields 209*a*, 209*b*. It should be understood that the previous description regarding the proximity sensor 202 is applicable to each of the proximity sensors 202*a*, 202*b*, where each can detect the teeth 62 of the drive gear 150 and provide a pulse train to the encoder card 206.

Figure 14:
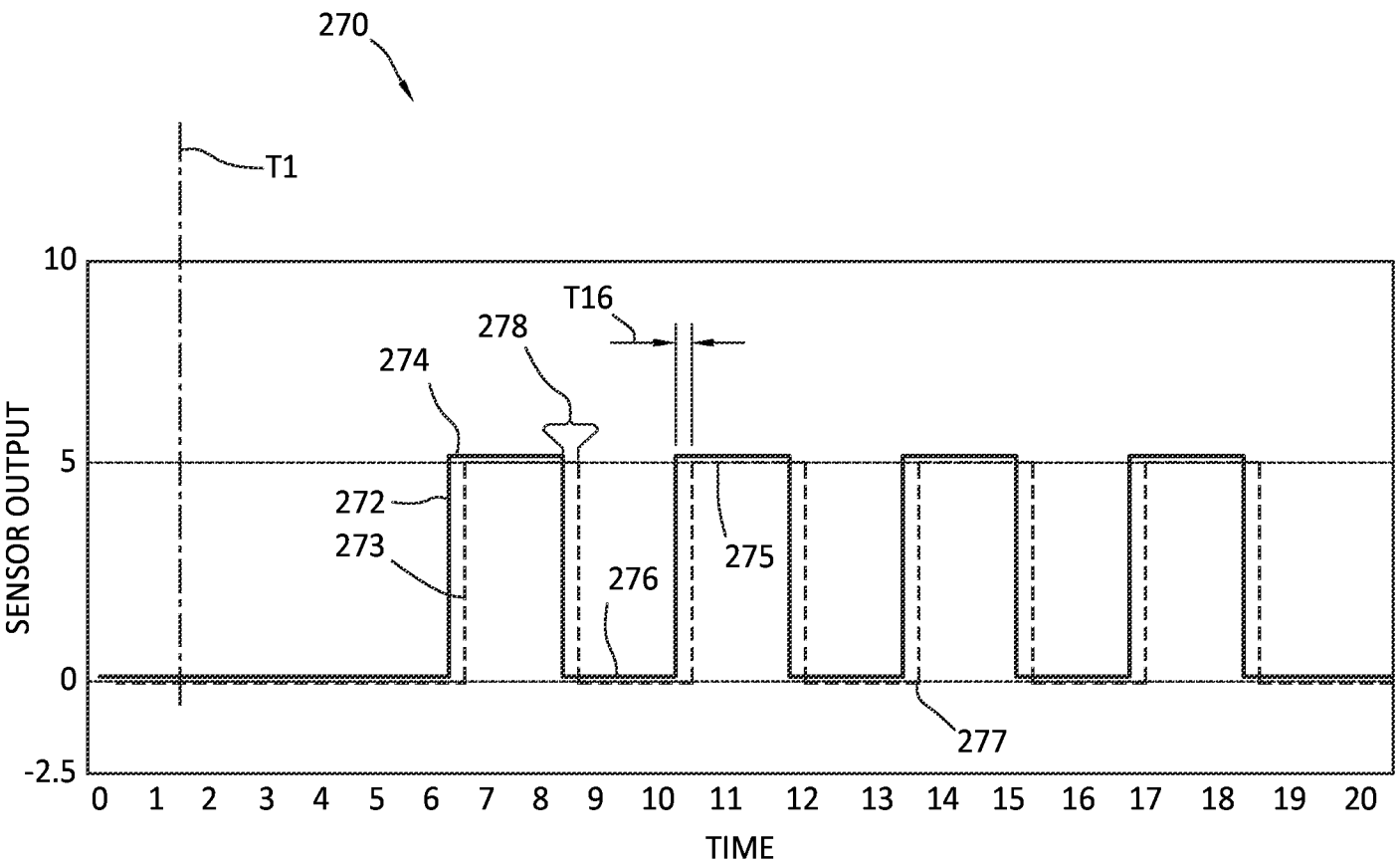
FIG. 14 is a representative plot of outputs from a pair of proximity sensors that are arranged as in FIG. 13, in accordance with certain embodiments.

Referring to FIG. 14, a benefit of having a pair of proximity sensors 208*a*, 208*b* instead of a single proximity sensor 208 is that the encoder card 204 (or the controllers 130 or 250) can compare the pulse trains from each of the proximity sensors 208*a*, 208*b* and determine which direction the drive gear 150 is rotating. FIG. 14 shows a plot 270 that includes two lines 272, 273. The line 272 represents a pulse train produced by the proximity sensor 208*a* with pulses 274 and valleys 276. The line 273 represents a pulse train produced by the proximity sensor 208*b* with pulses 275 and valleys 277. As can be seen in FIG. 14, the sensing fields 208*a*, 208*b* are slightly offset from each other. This can be done by placing one proximity sensor 200*a* above and slightly offset from the proximity sensor 208*b*.

As the drive gear 150 rotates, a tooth 62 will pass through the sensing fields 208*a*, 208*b*. However, the tooth will enter the sensing field of one proximity sensor before it enters the next. For example, if the drive gear 150 is rotating clockwise (arrow 170), then the tooth 62 will enter the sensing field 208*a* first before it enters the sensing field 208*b*, thereby causing the pulse generated by the proximity sensor 208*a* to be output at a time slightly ahead of when the pulse generated by the proximity sensor 208*b* is output. This can cause a shift 278 between the pulse trains (i.e. lines 272, 273) of time T16. When the encoder card 204 receives the pulses trains (i.e. lines 272, 273) it can determine (or other controllers 130 or 250) that the tooth 62 enters the sensing field 208*a* of the proximity sensor 200*a* before it enters the sensing field 208*b* of the proximity sensor 200*b*, thereby indicating the drive gear is rotating in a clockwise direction. The same analysis can be performed if the drive gear 150 were rotating in a counterclockwise direction, with the teeth entering the sensing field 208*b* before entering the sensing field 208*a*.

Figure 15B:
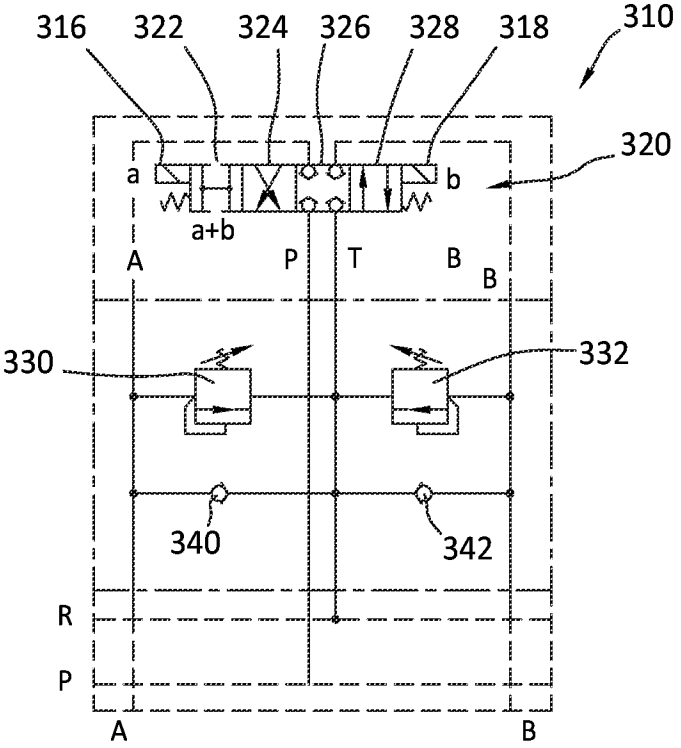
FIG. 15B is a representative hydraulic control circuit diagram for vertically adjusting of the spinner assembly, according to certain embodiments.
Figure 15A:
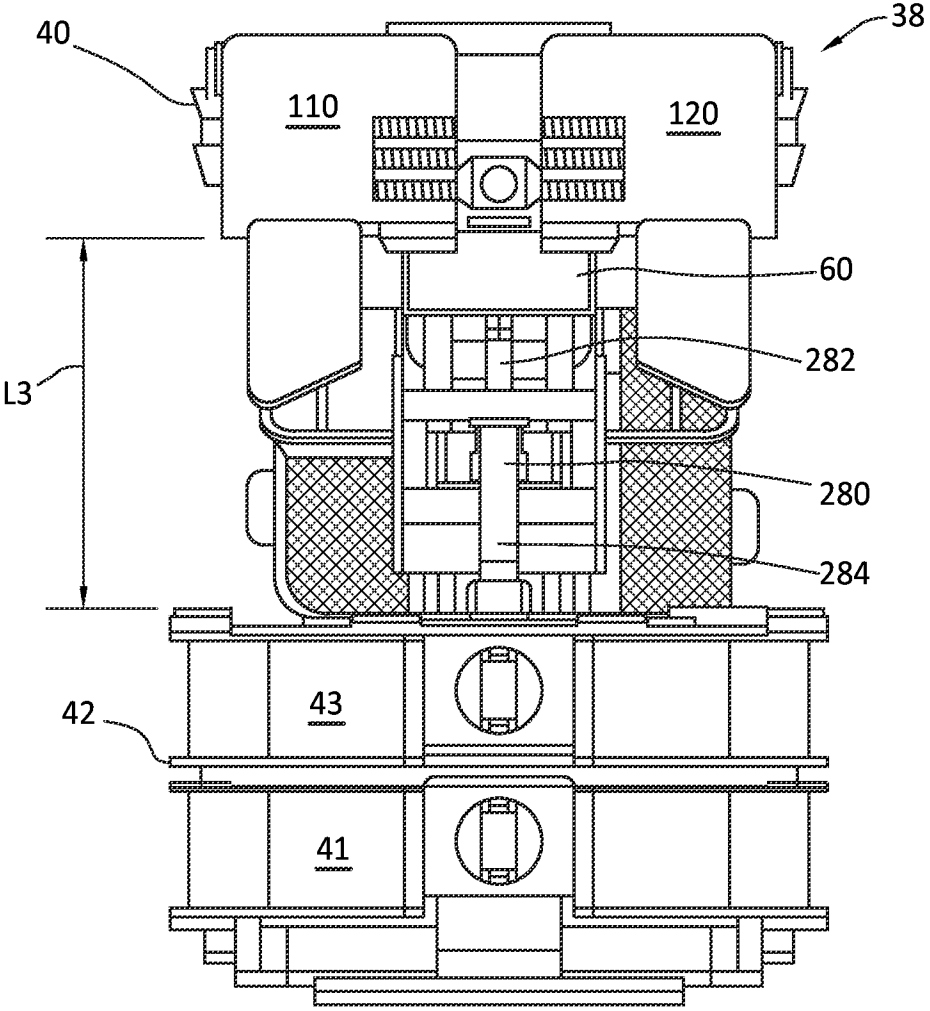
FIG. 15A is a representative front view of an iron roughneck, in accordance with certain embodiments.

Referring to FIG. 15A, the iron roughneck 38 can include a compensation system 290 for when the spinner assembly 40 is spinning a tubular in or out of connection with a tubular string 58. The compensation system 290 can include a vertically orientated actuator 280 and a hydraulic control circuit 310 (see FIG. 15B). The actuator 280 can vertically raise or lower the coupling assembly 60 of the spinner assembly 40, thereby vertically raising or lowering the spinner subassemblies 110, 120 relative to the torque wrench assembly 42 (i.e. varying the height L3). This vertical adjustment can be used to position the spinners 140 along the body of the tubular 54 as needed to spin the tubular 54 in or out. The compensation system 290 can provide weight compensation to offset the weight of spinner assembly 40 and the tubular 54 to minimize weight being applied to the joint of the tubular string 58 when the tubular 54 is being spun in or spun out. Also, the compensation system 290 provides for vertical movement of the spinner assembly 40 as the tubular 54 is being spun in or spun out, since the spinning in or out requires vertical displacement of the tubular 54 relative to the tubular string 58.

Referring now to FIG. 15B, a diagram of a hydraulic circuit 310 is provided that can be used to control the vertical displacement of the spinner assembly 40 via the actuator 280. "A" and "B" represent the fluid ports of the actuator 280, "P" represents pressure from a pressure source (e.g. a Hydraulic Power Unit HPU), "T" represents a tank (e.g. for collecting fluid from a return line to the HPU). A slide valve 320 can be used to control actuation of the actuator 280 by sliding the valve to one of a plurality of control positions 322, 324, 326, 328, with solenoids 316, 318 used to actuate the slide valve between the control positions. Injecting fluid into port "A" and releasing fluid from port "B" extends the piston 282. Injecting fluid into port "B" and releasing fluid from port "A" retracts the piston 282. The counterbalance valves 330, 332 operate to prevent fluid flow until the inlet pressure exceeds a predetermined value and causes the piston in the counterbalance valve to overcome a biasing force acting on the piston. When the piston overcomes the biasing force, the counterbalance valve allows fluid to flow from the pressurized input through the valve to the output. When the input pressure is reduced below the pre-determined value, then the counterbalance valve again prevents flow through the valve. The check valves 340, 342 act to allow only one-way fluid communication through the respective lines.

In operation, the normal configuration of the slide valve is for the valve to be at the control position 326 which is a "blocking" position. At control position 326, fluid is prevented from flowing in to or out of the ports "A" and "B". This locks the actuator piston at its current position. This control position 326 can be used when it is desired to prevent movement of the piston via the slide valve, yet the piston can still move via the counterbalance valves. The control position 322 that is a "float" position, where the ports "A" and "B" are in fluid communication with each other and the piston is allowed to extend or retract without resistance. The control position 324 that can be a "retract" position, where pressure P is applied through the slide valve 320 to the "B" port and the "A" port is in fluid communication with the return line "T". The control position 328 that can be an "extend" position, where pressure P is applied through the slide valve 320 to the "A" port and the "B" port is in fluid communication with the return line "T".

When the spinner assembly 40 is set to spin in or out a tubular 54, the slide valve can be moved to the control position 326 when the spinner assembly 40 has been moved to the desired vertical position by the actuator 280. The spinner assembly 40 can engage the tubular 54 with the spinners 140 and begin spinning the tubular 54.

If the tubular 54 is being spun into the end of the tubular string 58, then the spinner assembly will be pulled vertically down by the vertical movement of the tubular 54 as it is being threaded into the tubular string 58. Since the slide valve 320 is at control position 326, fluid is prevented from flowing through the slide valve. Therefore, the downward vertical movement of the tubular 54, and thus the spinner assembly 40 that is engaged with the tubular 54, will begin to build up pressure in the actuator 280 at the "A" port. When this pressure at the "A" port is equal to or exceeds the pre-determined value set by the counterbalance valve 330, the counterbalance valve 330 will open and allow fluid to flow through the counterbalance valve 330 to the "T" line, thus relieving pressure at port "A". Also, pressure at port "B" will be reduced and the check valve 342 can allow fluid to flow from the "T" line into the "B" port to prevent negative pressure at port "B".

If the tubular 54 is being spun out of the end of the tubular string 58, then the spinner assembly will be pulled vertically up by the vertical movement of the tubular 54 as it is being threaded out of the tubular string 58. Since the slide valve 320 is at control position 326, fluid is prevented from flowing through the slide valve. Therefore, the upward vertical movement of the tubular 54, and thus the spinner assembly 40 that is engaged with the tubular 54, will begin to build up pressure in the actuator 280 at the "B" port. When this pressure at the "B" port is equal to or exceeds the pre-determined value set by the counterbalance valve 332, the counterbalance valve 332 will open and allow fluid to flow through the counterbalance valve 332 to the "T" line, thus relieving pressure at port "B". Also, pressure at port "A" will be reduced and the check valve 340 can allow fluid to flow from the "T" line into the "A" port to prevent negative pressure at port "A".

The pre-determined value for the counterbalance valves 330, 332 can be set to compensate for the weight of the spinner assembly and the tubular 54, so the actuator 280 moves when the pre-determined value is exceeded (i.e. additional force caused by the vertical movement of the spinner assembly 40 during spin in or out operation). If the control position 322 is selected for the slide valve 320, then the piston of the actuator 280 is free to float and provides no counterbalance force to offset the weight of the spinner assembly 40 and the tubular 54. Therefore, the entire weight of the tubular 54 and the spinner assembly 40 can be acting on the threads of the connection.

Figure 16:
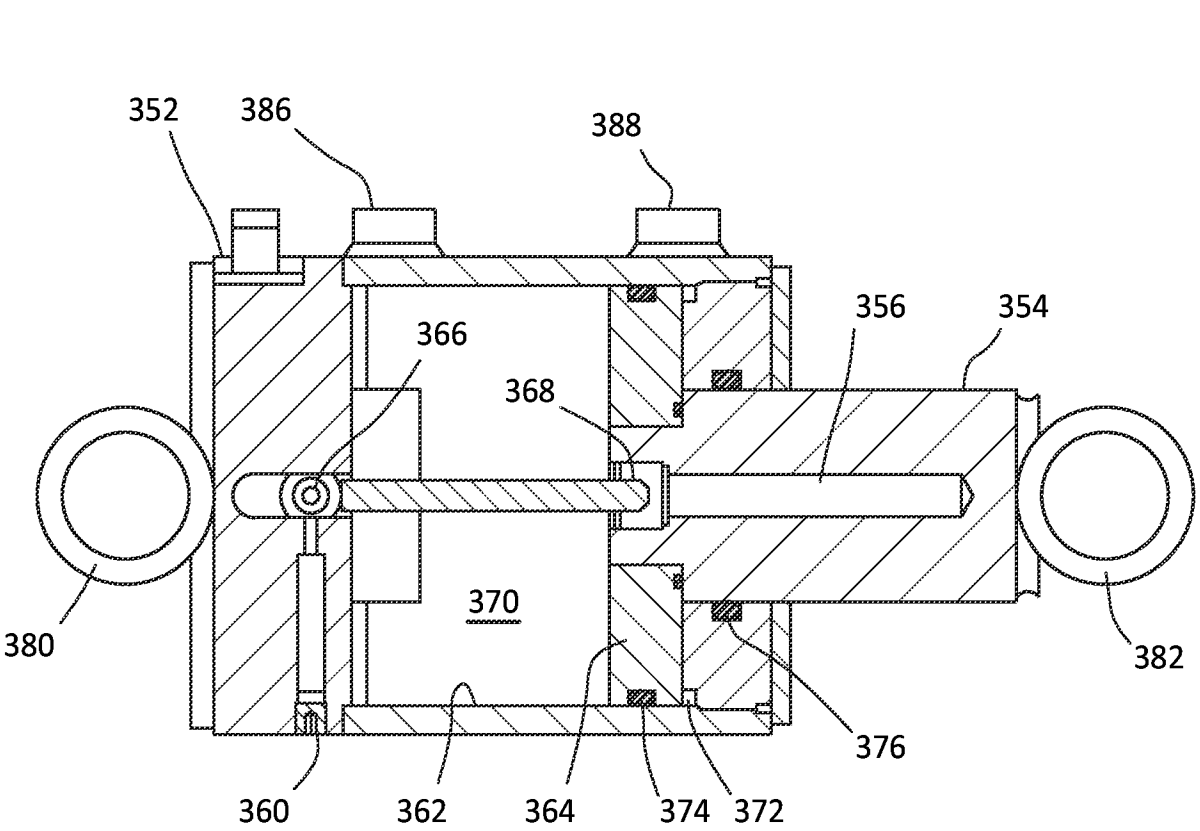
FIG. 16 is a representative partial cross-sectional view of an actuator with an LVDT sensor, in accordance with certain embodiments.

FIG. 16 is a representative partial cross-sectional view of an actuator 350, that can be used for actuators of the iron roughneck 38 (e.g. actuator 70, actuator 280), in accordance with certain embodiments. The end 380 can be rigidly attached to a body 352 of the actuator 350. The opposite end 382 can be rigidly attached to an end of a piston rod 354 that is extendable from the body 352. The opposite end of the piston rod 354 can include a cylindrical disk 364 that is slidably and sealingly coupled to a bore 362 in the body 352. The seal 374 can be used to seal the disk 364 to the bore 362. Fluid inlets 386, 388 can be used to drive the cylindrical disk 364 along the bore 362 in the body 352 to extend or retract the piston rod 354 as is well known in the art of pistons. The annular space 372 provides a volume for the inlet 388 to inject fluid into the actuator 350 to retract the piston rod 354. Injecting fluid into the cavity 370 can extend the piston rod 354. The seal 376 can slidingly and sealingly engage the piston rod 354 with the body 352.

The actuator 350 can include a Linear Variable Differential Transformer (LVDT) sensor. The LVDT sensor can detect and report a position of the piston rod 354 relative to the body 352. The LVDT sensor 366 can include a transducer electromagnetic core 368 that is stationary relative to the body 352 and can extend further into the bore 356 of the piston rod 354 as the piston rod 354 retracts from its fully extended position. A coil assembly in the transducer core 368 can detect the position of the piston rod 354 as it variably extends or retracts in the cavity 370 of the body 352. As the extension of the transducer core 368 varies within the bore 356, the transducer coil 368 correspondingly detects variations in its magnetic field which can be interpreted to determine the position of the transducer core 368 relative to the piston rod 354. The transducer coil 368 can receive electrical energy via the connection 360 as well as communicate the sensor signal to the controller (e.g. controller 250, 130) through the connection 360. The controller can provide proper signal conditioning for reading and processing the sensor signal.

Referring again to FIG. 15A, using an actuator 350 type actuator for the actuator 280, a controller (e.g. controller 250, controller 130, etc.) can use the relative position of the piston rod 282 relative to the body 284 to determine the vertical position of the spinner assembly 40 as well as the vertical position of the spinners 140, thereby providing real-time verification of the vertical position of the spinners 140. Monitoring, in real-time, the vertical position of the spinners 140, the controller can determine a vertical distance traveled by the spinners 140 when they spin in or out a tubular 54. The encoders 200, 202 (FIG. 3) can provide, in real-time, the number of turns performed when the tubular 54 is spun in or out of the connection to the tubular string 58.

Referring again to FIG. 3, using an actuator 350 type actuator for the actuator 70, a controller (e.g. controller 250, controller 130, etc.) can use the relative position of the piston rod of the actuator 70 to determine a horizontal position of each of the spinner subassemblies 110, 120 and thereby determine a diameter D2 of the tubular 54.

Therefore, the spinner assembly 40 and controller can be used to "map" a new connection for which parameters of the tubular 54 or have not been provided. As used herein, "map" or "mapping" the connection refers to the spinner assembly 40 and the controller 250, 130 being used to determine the thread pitch, number of threads, and diameter D2 of the tubular 54. If these parameters are known for the tubular 54, then mapping the connection can be used to verify the parameters of the tubular 54.

Various Embodiments

Embodiment 1. A system for conducting subterranean operations, the system comprising:
- a spinner assembly comprising:
  - an encoder; and
  - a spinner subassembly, the spinner subassembly comprising:
    - a spinner configured to engage a tubular; and
    - a drive gear coupled to the spinner, with the drive gear configured to drive rotation of the spinner, and the encoder configured to count teeth of the drive gear as the drive gear rotates.

Embodiment 2. The system of embodiment 1, wherein the drive gear is coupled to the spinner by a drive shaft, a belt, or linkage.

Embodiment 3. The system of embodiment 1, wherein the encoder comprises an encoder card disposed on the iron roughneck and disposed outside of the spinner assembly, and a proximity sensor coupled to the encoder card, with the proximity sensor disposed proximate the drive gear such that the teeth of the drive gear pass through a sensing field of the proximity sensor when the drive gear rotates.

Embodiment 4. The system of embodiment 3, wherein the encoder card counts a total number of teeth that pass through the sensing field during operation of the spinner assembly.

Embodiment 5. The system of embodiment 4, wherein the total number of teeth indicate a wear status of the spinner.

Embodiment 6. The system of embodiment 5, wherein the wear status indicates an acceptable amount of wear of the spinner.

Embodiment 7. The system of embodiment 5, wherein the wear status indicates an unacceptable amount of wear of the spinner.

Embodiment 8. The system of embodiment 7, wherein a maintenance operation is initiated based on the wear status.

Embodiment 9. The system of embodiment 3, wherein the proximity sensor produces a pulse train when the drive gear rotates, wherein the proximity sensor transmits the pulse train to the encoder card, and wherein the pulse train indicates when the teeth pass through the sensing field.

Embodiment 10. The system of embodiment 9, wherein a controller is configured to determine a rotational speed of the drive gear based on the pulse train.

Embodiment 11. The system of embodiment 9, wherein the pulse train indicates when the tubular is unthreaded from a tubular string.

Embodiment 12. The system of embodiment 1, wherein the spinner assembly comprises a first spinner subassembly and a second spinner subassembly, and wherein the encoder comprises a first encoder and a second encoder.

Embodiment 13. The system of embodiment 12, wherein the first spinner subassembly comprises:

a first spinner configured to engage the tubular; and a first drive gear coupled to the first spinner and configured to drive rotation of the first spinner, and the first encoder configured to count teeth of the first drive gear as the first drive gear rotates.

Embodiment 14. The system of embodiment 13, wherein the first encoder comprises a first encoder card and a first proximity sensor, and wherein a first proximity sensor is disposed proximate the first drive gear such that the teeth of the first drive gear pass through a first sensing field of the first proximity sensor when the first drive gear rotates.

Embodiment 15. The system of embodiment 14, wherein the first proximity sensor produces a first pulse train when the first drive gear rotates, wherein the first proximity sensor transmits the first pulse train to the first encoder card, and wherein the first pulse train indicates when the teeth of the first drive gear pass through the first sensing field.

Embodiment 16. The system of embodiment 15, wherein a controller is configured to determine a rotational speed of the first drive gear based on duration of pulses and valleys in the first pulse train.

Embodiment 17. The system of embodiment 15, wherein the second spinner subassembly comprises:

a second spinner configured to engage the tubular; and a second drive gear coupled to the second spinner and configured to drive rotation of the second spinner, and the second encoder configured to count teeth of the second drive gear as the second drive gear rotates.

Embodiment 18. The system of embodiment 17, wherein the second encoder comprises a second encoder card and a second proximity sensor, and wherein the second proximity sensor is disposed proximate the second drive gear such that the teeth of the second drive gear pass through a second sensing field of the second proximity sensor when the second drive gear rotates.

Embodiment 19. The system of embodiment 18, wherein the second proximity sensor produces a second pulse train when the second drive gear rotates, wherein the second proximity sensor transmits the second pulse train to the second encoder card, and wherein the second pulse train indicates when the teeth of the second drive gear pass through the second sensing field.

Embodiment 20. The system of embodiment 19, wherein a controller is configured to determine a rotational speed of the first drive gear based on duration of pulses and valleys in the first pulse train, and wherein the controller is configured to determine a rotational speed of the second drive gear based on duration of pulses and valleys in the second pulse train.

Embodiment 21. The system of embodiment 19, wherein a comparison of the first pulse train to the second pulse train indicates a wear status of the first spinner or the second spinner.

Embodiment 22. A system for conducting a subterranean operation, the system comprising:

a spinner subassembly comprising:

a plurality of spinners configured to engage and rotate a tubular;

a drive gear that is coupled to the plurality of spinners, with the drive gear configured to rotate the plurality of spinners;

a proximity sensor configured to detect teeth of the drive gear as the teeth pass through a sensing field of the proximity sensor; and a controller configured to receive first sensor data from the proximity sensor, wherein the first sensor data is representative of an actual number of revolutions of the plurality of spinners when the plurality of spinners engages the tubular.

Embodiment 23. The system of embodiment 22, wherein the actual number of revolutions comprise multiple revolutions, a single revolution, a partial revolution, or combinations thereof.

Embodiment 24. The system of embodiment 22, wherein the actual number of revolutions indicates a wear status of the plurality of spinners.

Embodiment 25. The system of embodiment 22, wherein the actual number of revolutions of the plurality of spinners is greater than a pre-determined number of revolutions and indicates a wear status of the plurality of spinners is unacceptable.

Embodiment 26. The system of embodiment 22, wherein the actual number of revolutions of the plurality of spinners is less than a pre-determined number of revolutions and indicates a wear status of the plurality of spinners is acceptable.

Embodiment 27. The system of embodiment 22, wherein the actual number of revolutions of the plurality of spinners is less than a pre-determined number of revolutions and indicates the tubular has been successfully threaded into a tubular string.

Embodiment 28. The system of embodiment 22, further comprising a torque sensor configured to measure torque applied to the drive gear, wherein an increase in the torque indicates the tubular is fully threaded to a tubular string.

Embodiment 29. A method for conducting a subterranean operation, the method comprising:

engaging a tubular with a spinner;

rotating a drive gear, with the drive gear coupled to the spinner;

rotating the spinner in response to rotating the drive gear;

rotating the tubular in response to rotating the spinner; and counting, via an encoder, teeth of the drive gear as the teeth pass through a sensing field of a proximity sensor.

Embodiment 30. The method of embodiment 29, further comprising calculating an actual number of the teeth that passes through the sensing field while the spinner engages the tubular.

Embodiment 31. The method of embodiment 30, determining a wear status of the spinner based on the actual number of the teeth.

Embodiment 32. The method of embodiment 31, wherein determining the wear status further comprises comparing the actual number of the teeth to a pre-determined number of teeth.

Embodiment 33. The method of embodiment 32, wherein the determining that the actual number of the teeth is less than the pre-determined number of teeth, thereby indicating that the wear status of the spinner is acceptable.

Embodiment 34. The method of embodiment 32, wherein the determining that the actual number of the teeth is less than the pre-determined number of teeth, thereby indicating that the tubular is fully threaded into a tubular string.

Embodiment 35. The method of embodiment 32, wherein the determining that the actual number of the teeth is greater than the pre-determined number of teeth, thereby indicating that the wear status of the spinner is unacceptable.

Embodiment 36. The method of embodiment 35, further comprising initiating a maintenance in response to indicating the wear status is unacceptable.

Embodiment 37. The method of embodiment 32, further comprising determining the pre-determined number of teeth by calculating a gap between a shoulder of a pin end of the tubular and a top end of the tubular string when the pin end of the tubular is setdown in a box end of the tubular string.

Embodiment 38. The method of embodiment 37, wherein determining the pre-determined number of teeth further comprises calculating a number of revolutions of the tubular needed to fully thread the tubular into the tubular string.

Embodiment 39. The method of embodiment 38, wherein determining the pre-determined number of teeth further comprises calculating a number of revolutions of the spinner based on the number of revolutions of the tubular.

Embodiment 40. The method of embodiment 29, wherein the proximity sensor produces a pulse train, and wherein each pulse of the pulse train indicates that one of the teeth of the drive gear passed through the sensing field of the proximity sensor.

Embodiment 41. The method of embodiment 40, further comprising determining a rotational speed of the drive gear based on the pulse train.

Embodiment 42. The method of embodiment 41, further comprising determining the tubular is fully unthreaded from a tubular string based on a variation in the rotational speed of the drive gear.

Embodiment 43. A system for conducting subterranean operations, the system comprising:

a spinner assembly comprising:

a first encoder;

a first spinner subassembly, the first spinner subassembly comprising:

a first spinner configured to engage a tubular; and a first drive gear coupled to the first spinner, with the first drive gear configured to drive rotation of the first spinner, and the first encoder configured to count teeth of the first drive gear as the first drive gear rotates;

a second encoder;

a second spinner subassembly, the second spinner subassembly comprising:

a second spinner configured to engage a tubular; and a second drive gear coupled to the second spinner, with the second drive gear configured to drive rotation of the second spinner, and the second encoder configured to count teeth of the second drive gear as the second drive gear rotates.

Embodiment 44. The system of embodiment 43, wherein the first encoder produces a first pulse train, wherein each pulse in the first pulse train indicates a tooth of the first drive gear that passed through a sensing field of the first encoder.

Embodiment 45. The system of embodiment 44, wherein the first pulse train indicates a wear status of the first spinner.

Embodiment 46. The system of embodiment 44, wherein the second encoder produces a second pulse train, wherein each pulse in the second pulse train indicates a tooth of the second drive gear that passed through a sensing field of the second encoder.

Embodiment 47. The system of embodiment 46, wherein the second pulse train indicates a wear status of the second spinner.

Embodiment 48. The system of embodiment 46, further comprising a controller, wherein the controller is configured to compare the first pulse train to the second pulse train and determine a wear status of the first spinner or the second spinner.

Embodiment 49. A method for conducting a subterranean operation, the method comprising:

adjusting, via a vertically oriented actuator, a height of a spinner assembly relative to a torque wrench assembly;

engaging a tubular with a spinner assembly by actuating a horizontally oriented actuator;

measuring a horizontal movement of the spinner assembly via a Linear Variable Differential Transformer (LVDT) sensor;

calculating an outer diameter of the tubular based on the measured horizontal movement of the spinner assembly;

spinning the tubular into a threaded connection with a tubular string;

measuring vertical movement of the spinner assembly as the tubular is spun into the threaded connection;

measuring, via an encoder, a number of revolutions of a spinner in the spinner assembly by sensing teeth of a drive gear coupled to the spinner as the teeth pass through a sensing field of the encoder;

determining thread pitch of a pen end of the tubular, thread diameter of the threads of the pin end of the tubular, and number of threads of the pin end of the tubular based on the number of revolutions of the spinner, the outer diameter of the tubular, and the vertical movement of the spinner assembly.

Embodiment 50. A method of varying torque of a spinner assembly, the method comprising:

installing a first drive gear in the spinner assembly;

coupling a spinner to the first drive gear via a first slave gear;

engaging the spinner with a tubular and applying a first rotational torque to the tubular;

removing the first drive gear and the first slave gear;

installing a second drive gear in the spinner assembly;

coupling the spinner to the second drive gear via a second slave gear;

engaging the spinner with the tubular and applying a second rotational torque to the tubular.

Furthermore, the illustrative methods described herein may be implemented by a system comprising a rig controller 250, 130 that can include a non-transitory computer-readable medium comprising instructions which, when executed by at least one processor of the rig controller 250, 130, causes the processor to perform any of the methods described herein.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

The invention claimed is:

1. A system for conducting subterranean operations, the system comprising:

a spinner assembly comprising:

an encoder; and a spinner subassembly, the spinner subassembly comprising:

a spinner with an outer gripping surface, wherein the outer gripping surface is configured to engage a tubular; and a drive gear coupled to the spinner via one or more other gears, with the drive gear configured to drive rotation of the spinner via engagement of teeth of the drive gear with the one or more other gears, and the encoder configured to count the teeth of the drive gear as the drive gear rotates, wherein the encoder detects an actual number of teeth that pass by the encoder, wherein the actual number of teeth indicates estimated revolutions of the tubular while the tubular is threaded into a second tubular via the spinner, and wherein an unacceptable wear status of the outer gripping surface is indicated when the estimated revolutions are greater than expected revolutions of the tubular.

2. The system of claim 1, wherein the encoder comprises an encoder card disposed on an iron roughneck and disposed outside of the spinner assembly, and a proximity sensor coupled to the encoder card, with the proximity sensor disposed proximate the drive gear such that the teeth of the drive gear pass through a sensing field of the proximity sensor when the drive gear rotates.

3. The system of claim 2, wherein the encoder card counts a total number of teeth that pass through the sensing field during operation of the spinner assembly.

4. The system of claim 3, wherein the total number of teeth indicate an acceptable or unacceptable amount of wear of the outer gripping surface of the spinner.

5. The system of claim 2, wherein the proximity sensor produces a pulse train when the drive gear rotates, wherein the proximity sensor transmits the pulse train to the encoder card, and wherein each pulse in the pulse train indicates when each tooth passes through the sensing field, and wherein a controller is configured to determine a rotational speed of the drive gear based on the pulse train.

6. The system of claim 1, wherein the spinner assembly comprises a first spinner subassembly and a second spinner subassembly, and wherein the encoder comprises a first encoder and a second encoder.

7. The system of claim 6, wherein the first spinner subassembly comprises:

a first spinner configured to engage the tubular; and a first drive gear coupled to the first spinner and configured to drive rotation of the first spinner, and the first encoder configured to count teeth of the first drive gear as the first drive gear rotates, wherein the first encoder produces a first pulse train, wherein each pulse in the first pulse train indicates that one of the teeth of the first drive gear passed through a sensing field of the first encoder;

wherein the second spinner subassembly comprises:

a second spinner configured to engage the tubular; and a second drive gear coupled to the second spinner and configured to drive rotation of the second spinner, and the second encoder configured to count teeth of the second drive gear as the second drive gear rotates, wherein the second encoder produces a second pulse train, wherein each pulse in the second pulse train indicates that one of the teeth of the second drive gear passed through a sensing field of the second encoder.

8. The system of claim 7, further comprising a controller, wherein the controller is configured to compare the first pulse train to the second pulse train, and wherein the comparison of the first pulse train to the second pulse train indicates a wear status of the first spinner or the second spinner.

9. A method for conducting a subterranean operation, the method comprising:

engaging a tubular with a spinner;

rotating a drive gear, with the drive gear being coupled to the spinner via one or more other gears;

rotating the spinner in response to rotating the drive gear, wherein rotating the spinner comprises engaging teeth of the drive gear with the one or more other gears and rotating the one or more other gears in response to engaging the teeth with the one or more other gears and rotating the drive gear;

rotating the tubular in response to rotating the spinner;

counting, via an encoder, the teeth of the drive gear as the teeth pass through a sensing field of a proximity sensor;

calculating, via a rig controller, estimated revolutions of the tubular based on an actual number of teeth counted while the tubular is being threaded into a second tubular by the spinner;

comparing the estimated revolutions of the tubular to expected revolutions of the tubular; and determining a wear status of the spinner based on the comparing.

10. The method of claim 9, wherein determining the wear status further comprises determining that the estimated revolutions are greater than the expected revolutions, thereby indicating that the wear status of the spinner is unacceptable.

11. The method of claim 9, wherein determining the wear status further comprises comparing the actual number of teeth counted to a pre-determined number of teeth, and wherein determining that the actual number of teeth is greater than the pre-determined number of teeth, thereby indicating that the wear status of the spinner is unacceptable.

12. The method of claim 9, wherein the proximity sensor produces a pulse train, and wherein each pulse of the pulse train indicates that one of the teeth of the drive gear passed through the sensing field of the proximity sensor.

13. The method of claim 12, further comprising determining a rotational speed of the drive gear based on the pulse train.

14. A method for conducting a subterranean operation, the method comprising:

engaging a tubular with a spinner;

rotating a drive gear, with the drive gear coupled to the spinner;

rotating the spinner in response to rotating the drive gear;

rotating the tubular in response to rotating the spinner;

counting, via an encoder, teeth of the drive gear as the teeth pass through a sensing field of a proximity sensor;

calculating an actual number of the teeth that passes through the sensing field while the spinner engages the tubular;

determining a wear status of the spinner based on the actual number of the teeth counted, wherein determining the wear status further comprises comparing the actual number of the teeth counted to a pre-determined number of teeth; and determining the pre-determined number of teeth by determining a gap between a shoulder of a pin end of the tubular and a top end of a tubular string when the pin end of the tubular is setdown in a box end of the tubular string.

15. The method of claim 14, wherein determining the pre-determined number of teeth further comprises calculating a number of revolutions of the tubular needed to fully thread the tubular into the tubular string and calculating a number of revolutions of the spinner based on the number of revolutions of the tubular.

* * * * *